US010744784B2

(12) United States Patent
Yokoi

(10) Patent No.: US 10,744,784 B2
(45) Date of Patent: Aug. 18, 2020

(54) TUBE PUMP AND LIQUID EJECTION APPARATUS

(71) Applicant: CANON KABUSHIKI KAISHA, Tokyo (JP)

(72) Inventor: Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/056,861

(22) Filed: Aug. 7, 2018

(65) Prior Publication Data

US 2019/0047295 A1 Feb. 14, 2019

(30) Foreign Application Priority Data

Aug. 10, 2017 (JP) ..... 2017-155639

(51) Int. Cl.
*B41J 2/165* (2006.01)
*B41J 2/175* (2006.01)
*F04B 43/12* (2006.01)

(52) U.S. Cl.
CPC ..... *B41J 2/17596* (2013.01); *B41J 2/16505* (2013.01); *B41J 2/16508* (2013.01); *B41J 2/16523* (2013.01); *F04B 43/1253* (2013.01); *F04B 43/1276* (2013.01)

(58) Field of Classification Search
None
See application file for complete search history.

(56) References Cited

U.S. PATENT DOCUMENTS

2002/0044167 A1* 4/2002 Miyauchi ..... B41J 2/16523 347/30
2005/0285892 A1* 12/2005 Harada ..... B41J 2/17596 347/29
2008/0049064 A1* 2/2008 Asai ..... B41J 2/16532 347/30
2016/0052274 A1* 2/2016 Kanome ..... B41J 2/17596 347/29

FOREIGN PATENT DOCUMENTS

JP 2000062208 A 2/2000
JP 2005271377 A 10/2005

* cited by examiner

*Primary Examiner* — Matthew Luu
*Assistant Examiner* — Tracey M McMillion
(74) *Attorney, Agent, or Firm* — Venable LLP

(57) ABSTRACT

The present invention is intended to provide a tube pump which can suppress occurrence of a back flow of liquid in a tube at the time of reverse rotation of a second rotating body, with a simple configuration. The tube pump includes a tube; a case; a roller making a specific movement; a first rotating body having a guiding part which guides the roller in an arc radial direction of the arc-shaped wall surface of the case; and a second rotating body having a roller position regulating part acting on a position in an arc radial direction of the arc-shaped wall surface of the case of the roller.

18 Claims, 23 Drawing Sheets

TUBE PUMP AND LIQUID EJECTION APPARATUS

BACKGROUND OF THE INVENTION

Field of the Invention

The present invention relates to a tube pump and a liquid ejection apparatus.

Description of the Related Art

Japanese Patent Application Laid-Open No. 2000-62208 discloses a configuration of a tube pump including a pump frame; a rotating body; a cam member; and a braking unit, as shown in FIG. 3. Here, the pump frame has a tube supporting surface regulating the outer shape of the tube into an arc shape. The rotating body has a lever supporting a roller so that the roller is movable to a first position and a second position, the first position pressing the tube to a tube supporting surface side, and the second position releasing a pressed tube. The cam member is rotated by driving force from a driving unit to move the roller supported by the lever to the first position or the second position. The braking unit brakes the rotation of the rotating body, in the state that the roller is moved between the first position and the second position, by rotation of the cam member. The braking unit includes a support shaft supporting the cam member so that the cam member is rotatable, and a coil-shaped spring fitted to the support shaft, and the braking of the rotating body is released by rotational action of the cam member in a loosening direction of the coil-shaped spring.

By the configuration as described above, rotation of the rotating body at the time of moving the roller to the first position or the second position is braked, so that the rotating body can be rotated after determining a roller position. As a result, the tube pump suppresses occurrence of liquid backflow in the tube at the time of reverse rotation of the rotating body.

However, since the tube pump described in Japanese Patent Application Laid-Open No. 2000-62208 has a configuration of moving the lever supporting the roller between the first position and the second position, by the cam member, it has a large number of parts to the roller to be controlled. In addition, as the number of parts is large, the tube pump described in Japanese Patent Application Laid-Open No. 2000-62208 is likely to cause variations in positional accuracy of the roller.

An object of the present invention is to provide a tube pump which can suppress occurrence of liquid backflow in the tube at the time of reverse rotation of a second rotating body, by a simple configuration.

SUMMARY OF THE INVENTION

The tube pump of the present invention includes: a tube having elastic restoring force; a case having an arc-shaped wall surface regulating and supporting a position of the tube; a roller disposed so that it can press the tube between the roller and the wall surface of the case; a first rotating body which is rotatable around an arc center of the arc-shaped wall surface of the case, and has a guiding part for guiding the roller so that the roller is movable in an arc radial direction of the arc-shaped wall surface of the case; and a second rotating body which is a rotating body rotating around the arc center of the arc-shaped wall surface of the case, and has a roller position regulating part for acting on a position in an arc radial direction of the arc-shaped wall surface of the case of the roller, wherein the first rotating body has a drive transmitting part provided between the first rotating body and the second rotating body so that the first rotating body rotates by receiving rotational driving force of the second rotating body, in the drive transmitting part, a dead zone in which rotation of the second rotating body is not transmitted to first rotating body for a predetermined amount of rotation when a rotation direction is changed is set, and the roller, when the first rotating body rotates in a predetermined direction, moves the guiding part of the first rotating body to a tube side by an action of the roller position regulating part provided in the second rotating body, thereby pushing the tube between the roller and the arc-shaped wall surface of the case so that the roller is circulated, and when the second rotating body starts to rotate in a reverse direction, moves the guiding part of the first rotating part in a direction to release pressing of the tube by an action of the roller position regulating part provided in the second rotating body and elastic restoring force of the tube, until a state that rotation of the second rotating body by the dead zone of the drive transmitting part is not transmitted to the first rotating body is ended.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings on the basis of the first to fifth exemplary embodiments.

First Exemplary Embodiment (Overall Configuration of Inkjet Recording Apparatus)

Figure 1:
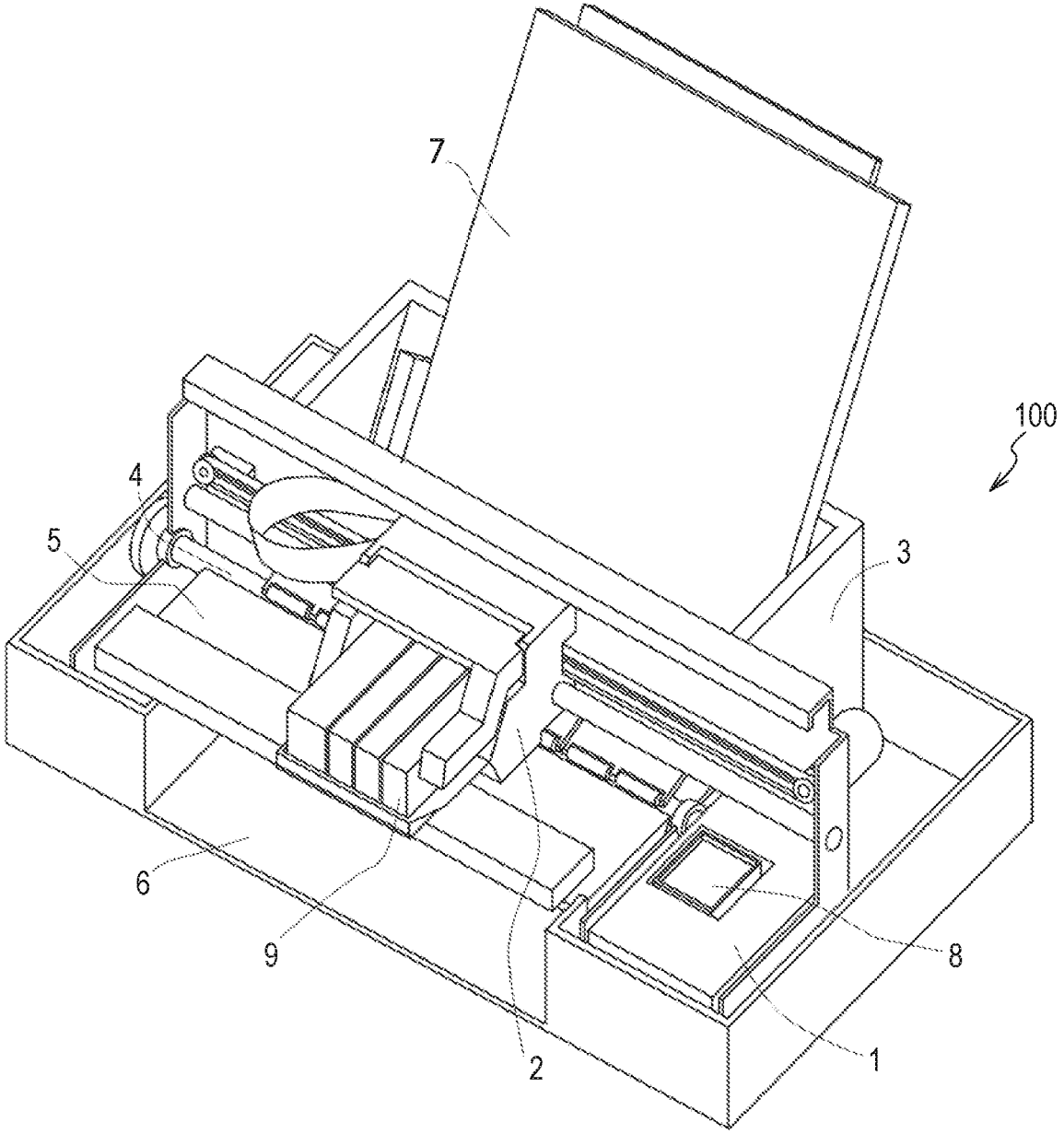
FIG. 1 is a schematic configuration diagram of a recording device including the tube pump of a first exemplary embodiment.

FIG. 1 is a schematic diagram of the inkjet recording apparatus 100 of the present exemplary embodiment (an example of a recording device). The inkjet recording apparatus 100 includes a maintenance unit 1; a carriage 2; a paper feed unit 3; a conveying roller 4; a discharge part 6; an ink tank 9; and a recording head 10 (see FIGS. 2A and 2B, an example of a liquid ejection head). Here, the maintenance unit 1 is regarded as being for maintaining ejection reliability of the recording head, and includes a cap 8 and a tube pump 12 forming a part thereof (see FIGS. 2A, 2B, 3, and the like). The cap 8 has a function of sealing the recording head 10. The paper feed unit 3 has a function of separating a recording medium 7 one by one to feed them to a downstream side in a conveying direction. The conveying roller 4 has a function of conveying the recording medium 7 fed from the paper feed unit 3 to a recording position 5 composed of a scanning area of the carriage. The discharge part 6 is a part from which the recording medium 7 which has completed recording is discharged. The ink tank 9 is for supplying ink (an example of liquid) to the recording head 10. The recording head 10 has a function of ejecting ink to the recording medium 7 according to recording information.

Figure 2A:
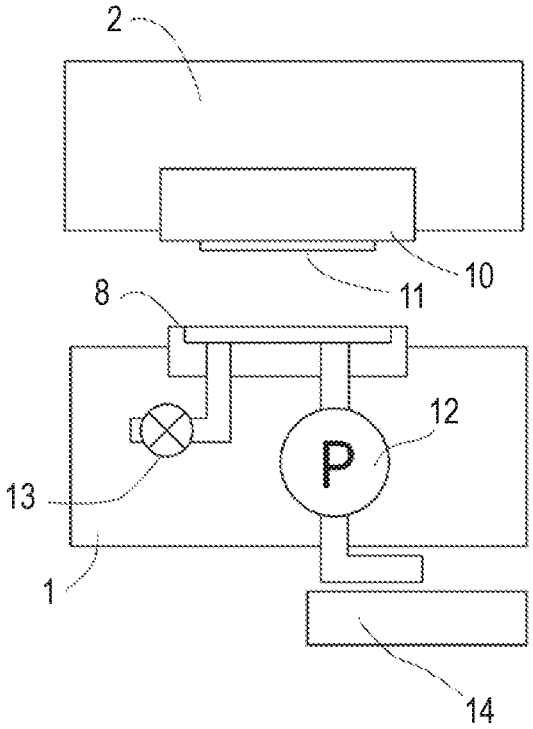
FIGS. 2A and 2B are drawings representing an outline of a function of a maintenance unit in the recording device of a first exemplary embodiment.
Figure 2B:
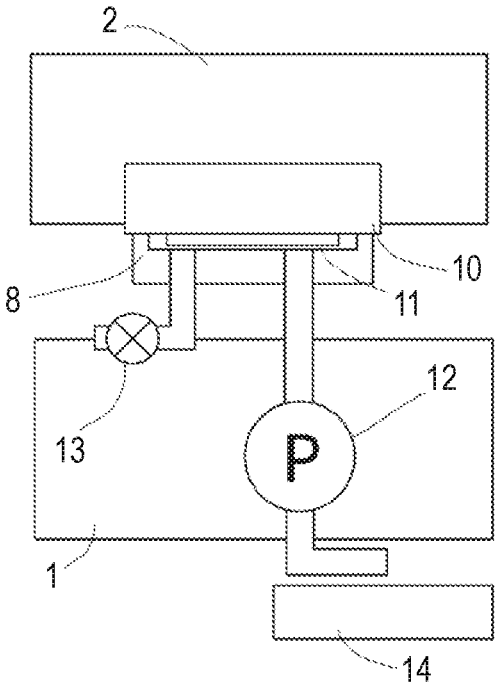

FIGS. 2A and 2B are drawings for describing an outline of the function of a maintenance unit 1. The maintenance unit 1 includes an atmospheric release valve 13 connected to a cap 8; and a waste ink absorber 14 maintaining ink discharged by the tube pump 12.

(Operation of Maintenance Unit)

Here, the maintenance operation by the maintenance unit 1 is described with reference to FIGS. 2A and 2B. When failure occurs in the ink ejection function of the recording head 10, the maintenance operation of the recording head 10 by the maintenance unit 1 is performed automatically or by user's determination. When the maintenance operation is performed, the carriage 2 moves to a position where the face surface 11 of the recording head 10 faces the cap 8, as shown in FIG. 2A. Then the cap 8 abuts on the face surface 11 to seal the face surface 11, as shown in FIG. 2B. In addition, in this case (where the cap 8 seals the face surface 11), the atmospheric release valve 13 is closed. Then, the tube pump 12 performs a suction operation inside the space hermetically formed on the face surface 11 (inside the cap 8), thereby generating negative pressure inside the cap 8. When the negative pressure is generated inside the cap 8, ink is drawn out from an ejection opening (not shown) of the face surface 11 of the recording head 10 (an example of an ejection orifice surface) by the negative pressure, so that bubbles, foreign matters, and the like inside the ejection opening causing the failure of an ink ejection function are drawn out together with the ink. As a result, the recording head 10 recovers the ink ejection function. Then, the tube pump 12 continues the suction operation with the atmospheric release valve 13 open, thereby removing the ink drawn into the cap 8, and discharging the ink to the waste ink absorber 14.

(Configuration of Tube Pump)

Figure 3:
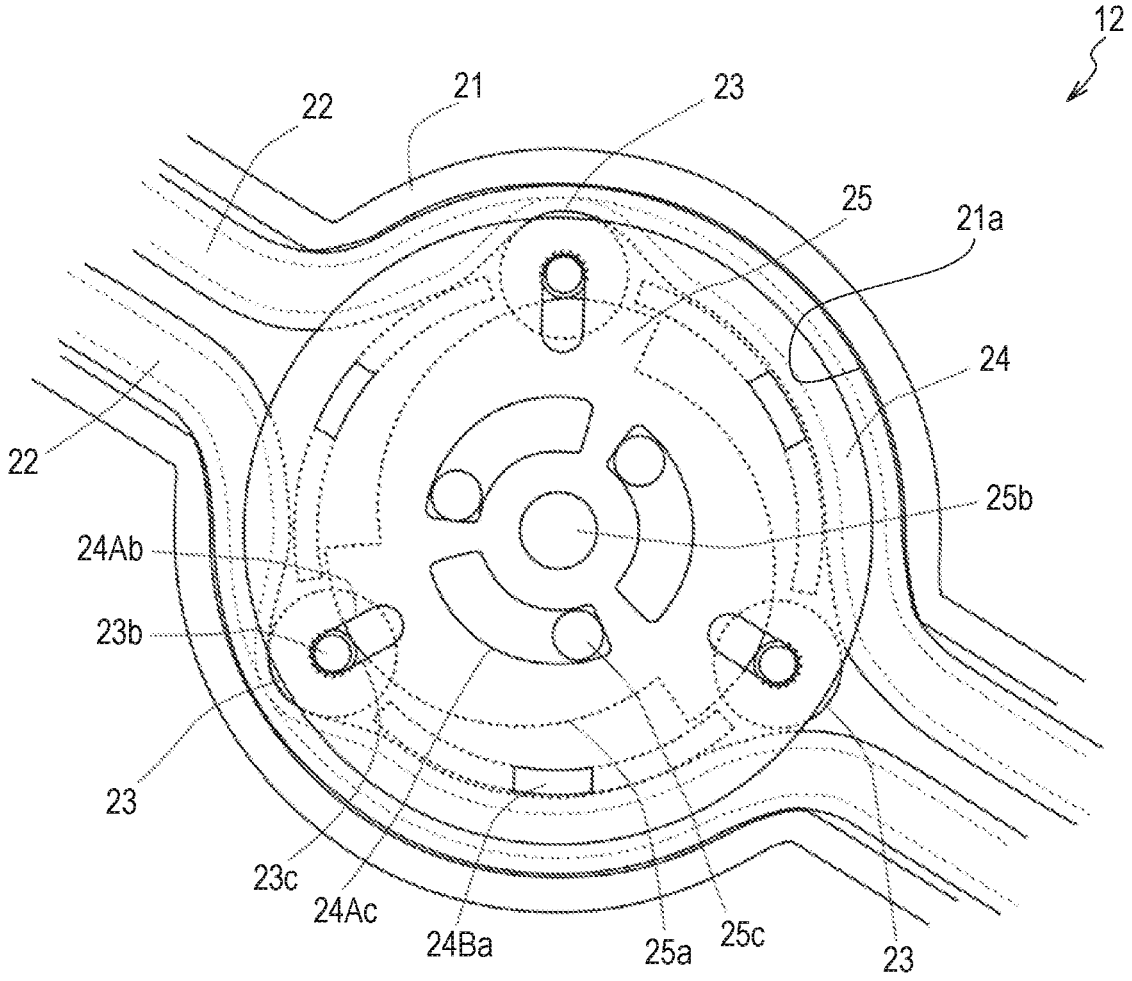
FIG. 3 is a drawing representing a configuration of the tube pump of a first exemplary embodiment.
Figure 4:
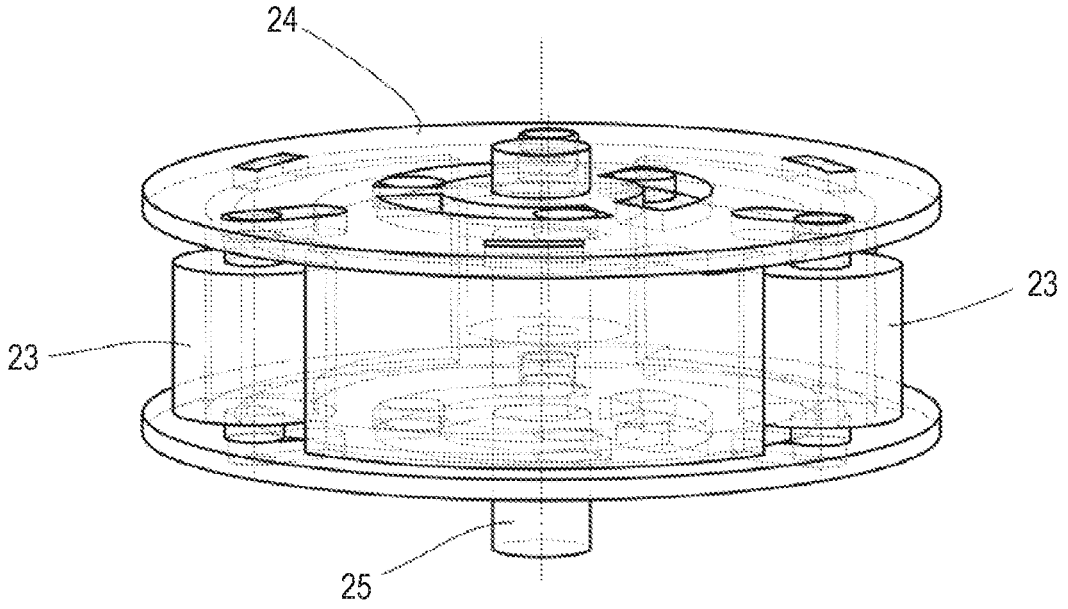
FIG. 4 is a perspective view of a part of the tube pump of a first exemplary embodiment.
Figure 5:
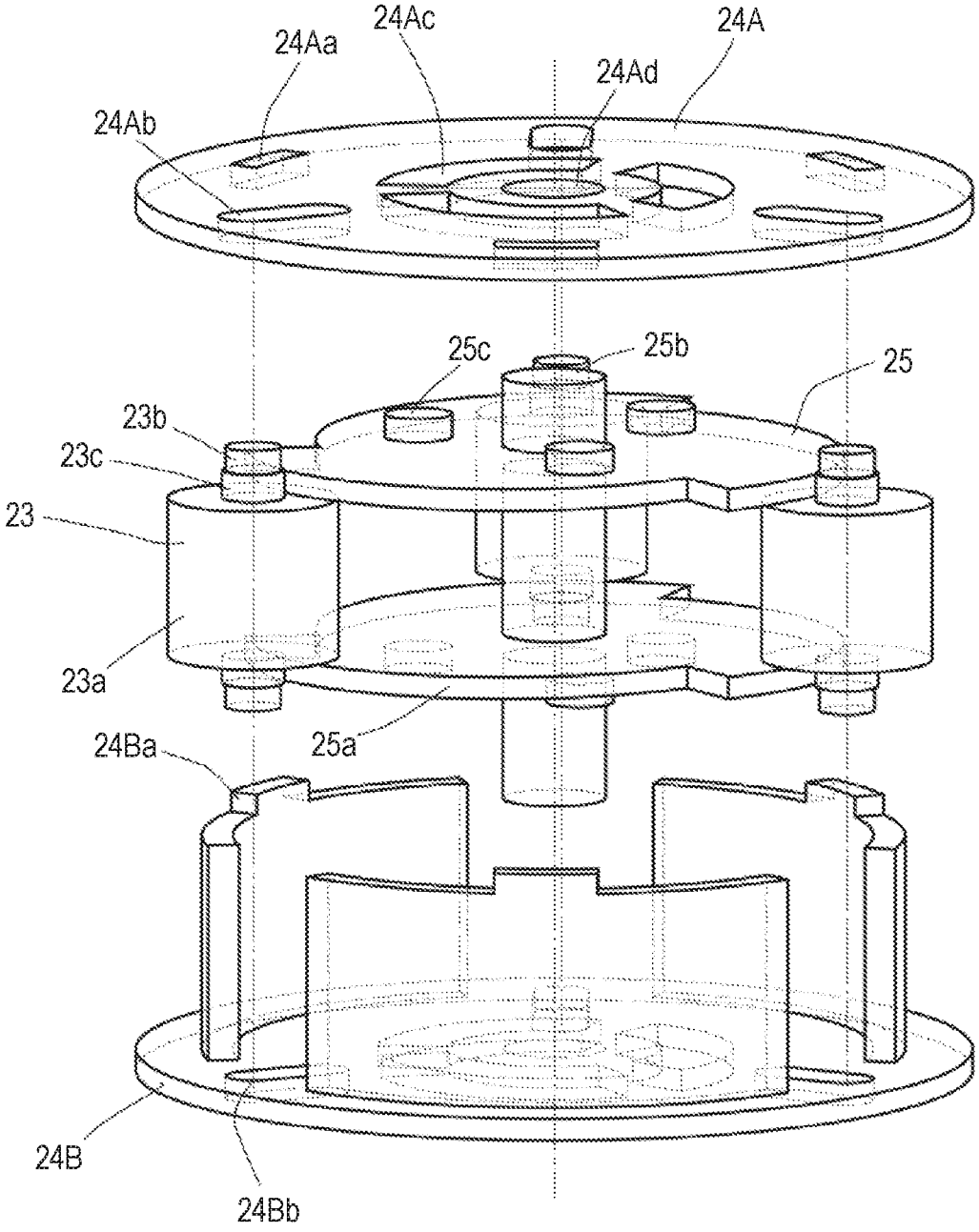
FIG. 5 is an exploded perspective view of a part of the tube pump of a first exemplary embodiment.

Next, the configuration of the tube pump 12 of the present exemplary embodiment is described, referring to FIGS. 3, 4, and 5. FIG. 3 is a schematic configuration diagram representing the overall tube pump 12, FIG. 4 is a perspective view representing the appearance of a rotor rotating inside the tube pump 12, and FIG. 5 is a configuration diagram representing the component configuration of the rotor.

The tube pump 12 of the present exemplary embodiment includes a case 21; a tube 22; a roller member 23 (an example of a roller) forming the rotor; a roller holding member 24 (an example of a first rotating body); and a drive rotating body 25 (an example of a second rotating body).

The tube 22 is composed of materials having elastic restoring force. The case 21 has a circular lower surface, and a wall surface 21*a* (an example of an arc-shaped wall surface) which is curved in an arc shape toward the inside, the center of the arc forming the wall surface 21*a* is the rotation center of the rotor, and the tube 22 is disposed in an arc shape along the wall surface 21*a*. The roller member 23 is disposed so that it can press the tube 22 at a position facing the wall surface 21*a* with the tube 22 disposed on the wall surface 21*a* of the case 21 interposed therebetween.

The rotor rotates during a suction operation of the tube pump 12, and the roller member 23 which is a component thereof circulates while pressing the tube 22 between the roller member 23 and the wall surface 21*a*. Then, negative pressure is generated in the tube 22 by moving the pressing position, and by the negative pressure, negative pressure is generated in the cap 8. The roller member 23 of the present exemplary embodiment has a cylindrical part 23*a* (an example of a cylindrical body) for pressing the tube 22; a rotating shaft 23*b*; and a shaft part 23*c* under the action of the drive rotating body 25, as shown in FIG. 5. The diameter of the cylindrical part 23*a* is larger than those of the rotating shaft 23*b* and the shaft part 23*c*. The shaft parts 23*c* are each provided on the outside from both ends in an axial direction of the cylindrical part 23*a*, and the rotating shaft 23*b* is further provided on the opposite side of the cylindrical part 23*a* with each shaft part 23*c* interposed therebetween from each shaft part 23*c*. In the present exemplary embodiment, examples of using three roller members 23 are represented, as shown in FIGS. 3 to 5.

The roller holding member 24 is a member forming a portion of the rotor disposed in the case 21, and as shown in FIGS. 4 and 5, it is composed of two members (an example of a plane member, roller holding members 24A and 24B) positioned on the outside in a rotating shaft direction of the rotor. The two members 24A and 24B are integrally rotatable around the arc center of the wall surface 21*a* of the case 21, by joining a joining hole 24Aa provided on 24A and a joining convex portion 24Ba provided on 24B. The roller holding member 24 engages the rotating shaft 23*b* of the roller member 23 with the elongated holes 24Ab and 24Bb (an example of a guiding part) formed at a position where two members 24A and 24B face each other, thereby guiding the roller member 23 in an arc radial direction of the wall surface 21*a* of the case 21 to allow movement within a predetermined range and maintain it.

The drive rotating body 25 is a constituent member disposed in the case 21, and provided to be sandwiched between the two members 24A and 24B of the roller holding member 24 of the rotor shown in FIGS. 4 and 5, and is driven by rotational driving force imparted to the drive shaft 25*b* which is the rotating shaft of the rotor from a driving source (not shown), and rotates.

The drive rotating body 25 is in the form of two flat plates provided with a cam surface 25*a* acting on the shaft part 23*c* of the roller member 23, disposed on the drive shaft 25*b*, as shown in FIG. 5. On the two flat plates, a boss 25*c* (an example of a protrusion) which is an engagement portion for transmitting the driving force of the drive rotating body 25 to the roller holding member 24 is formed. The two members 24A and 24B of the roller holding member 24 are provided with an engagement hole 24Ac (an example of a hole) and 24Bc (not shown) engaged with the boss 25*c*, and by engaging the engagement hole 24Ac with the boss 25*c*, the rotation drive of the drive rotating body 25 is transmitted to the roller holding member 24.

The engagement hole 24Ac provided on the roller holding rotating member 24 is an arc-shaped hole in a predetermined angle centered on a through-hole 24Ad center of the roller holding member 24 engaged with a drive shaft 25*b* of the drive rotating body 25 which is the rotor rotation center, and when the drive rotating body 25 rotates, the boss 25*c* abuts against one end of the arc of the engagement hole 24Ac and pushes it, thereby transmitting drive.

When the drive rotating body 25 reverses the rotation direction after rotating the roller holding member 24, the rotation drive of the drive rotating body 25 is not transmitted to the roller holding rotating member 24, until the boss 25*c* of the drive rotating body 25 reaches the opposite side end of the engagement hole 24Ac.

Next, the cam surface 25*a* (a roller position regulating part) provided on the two flat plates of the drive rotating body 25 is described.

Figure 6:
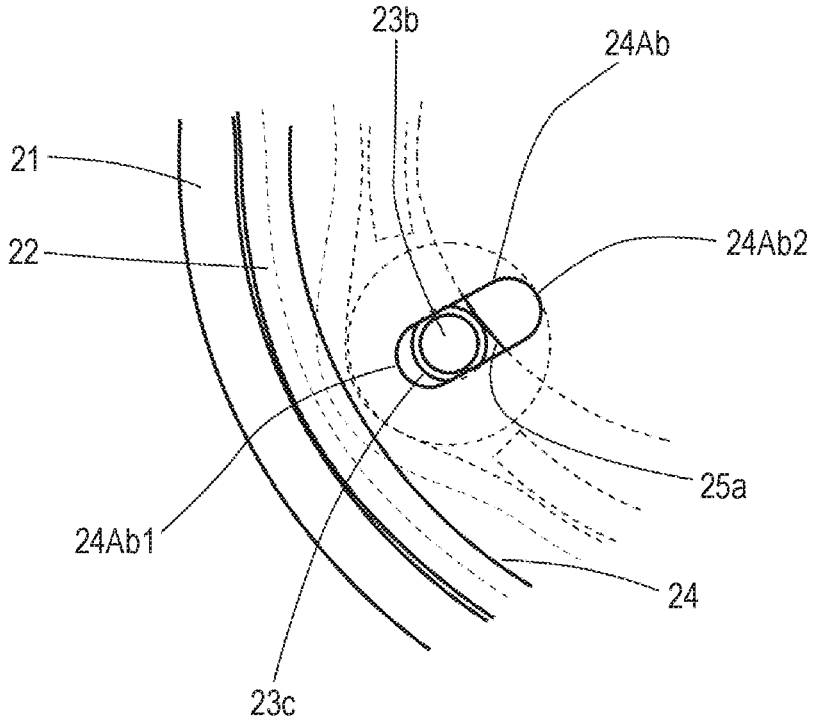
FIG. 6 is a drawing representing a positional relationship of each member of the tube pump of a first exemplary embodiment.

The elongated hole 24Ab of the roller holding member 24 is for guiding the roller member 23 movably from a tube side end 24Ab1 of the elongated hole 24Ab to a rotor center side end 24Ab2. However, the cam surface 25*a* acts on the shaft part 23*c* of the roller member 23, as shown in FIG. 6, and when the shaft part 23*c* of the roller member reaches the cam surface 25*a*, even in the case that the rotating shaft 23*b* of the roller member does not reach the rotor center side end 24Ab2 of the elongated hole 24Ab, the roller member 23 is not moved in a rotor center direction any more. That is, the cam surface 25*a* determines the position of the rotor center side which is one end of a movable range of the roller member 23 in the elongated hole 24Ab of the roller holding member 24, thereby serving to determine the position from the drive shaft 25*b* which is the rotor center of the roller member 23, that is, the position to the tube 22 disposed along the wall surface 21*a* of the case 21. In addition, by the action of the cam surface 25*a*, the roller member 23 is changed (changed by a predetermined amount) from a first position in the vicinity of the tube side end (in the vicinity of one end) of the elongated hole 24Ab pressing the tube 22 to a second position in the vicinity of the rotor center side end (in the vicinity of the other end) of the elongated hole 24Ab capable of releasing the pressing by the repulsive force against the pressing of the tube 22, between the roller member 23 and the wall surface 21*a* of the case 21.

The cam surface 25*a* gradually changes a distance from the drive shaft 25*b* center which is the rotor center with a predetermined rotation angle so that the position of the roller member 23 in the elongated hole 24Ab is defined to reach the first position from the second position, whereby the first position side of the surface is formed of a surface having a constant radius. The rotation angle of the rotor required to move the roller member 23 from the second position to the first position by the cam surface 25*a* is smaller than the formation angle of the engagement holes 24Ac and 24Bc in the rotation direction provided on the two plane members of the roller holding member 24 which is the dead zone of the drive transmitting part. In this case, in the dead zone, the rotation of the drive rotating body 25 is not transmitted to the roller holding member 24 for a predetermined rotation amount. The formation angle about the rotation center of the drive rotating body 25 of the gradually changed radius portion of the surface defining from the second position to the first position of the roller member 23 of the roller holding member 24 is smaller than the formation angle of the elongated hole in the rotation direction provided on the two plane members of the roller holding member 24 which is the dead zone of the drive transmitting part.

(Operation of Tube Pump)

Next, the movements of the roller member 23, the roller holding rotating member 24, and the drive rotating body in each operation of the tube pump 12 in the present exemplary embodiment are described, referring to FIGS. 7A to 7E.

In the tube pump 12 of the present exemplary embodiment, a rotation direction in which the left rotation (counterclockwise) direction (an example of a predetermined direction) of the drive rotating body 25 is used as a suction operation, and the right rotation (clockwise) thereof is used as release of the pressing of the tube 22 is shown in each drawing.

Figure 7A:
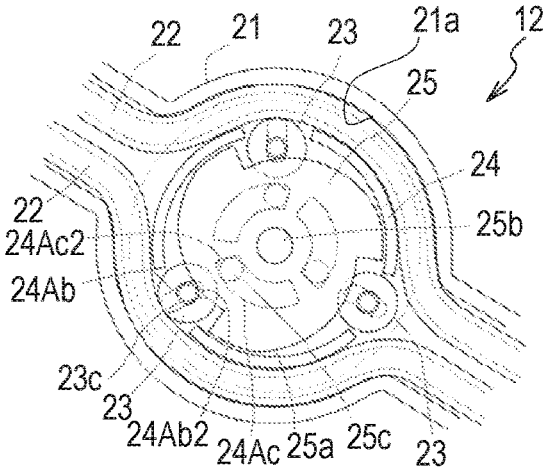
FIGS. 7A, 7B, 7C, 7D, and 7E are drawings representing the operation of each member of the tube pump of a first exemplary embodiment.
Figure 7D:
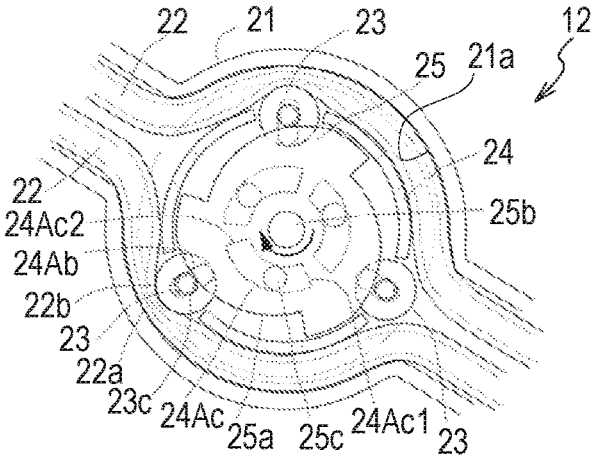
Figure 7B:
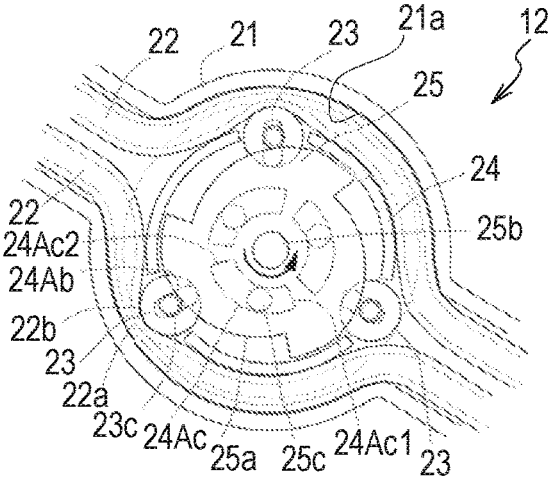
Figure 7E:
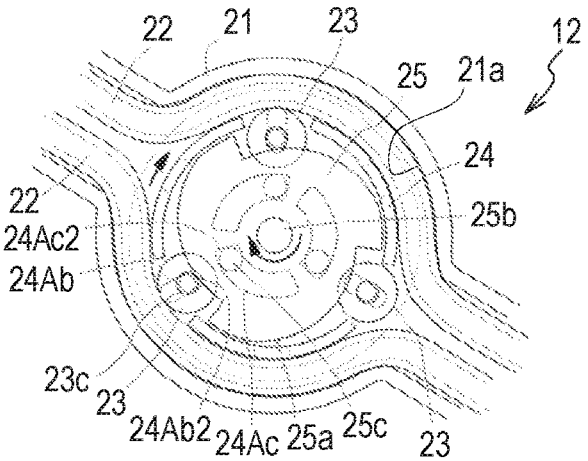
Figure 7C:
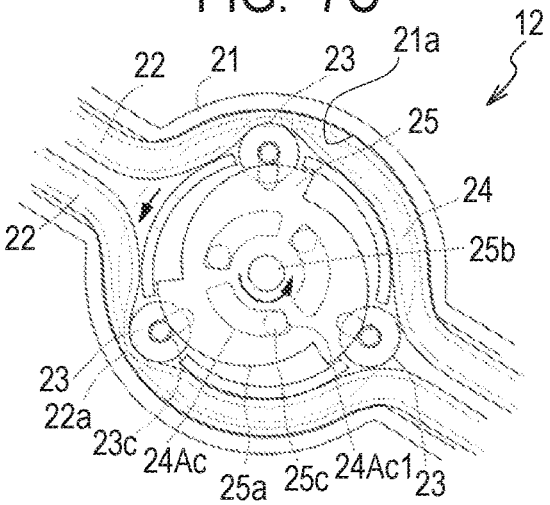

First, the operation of each part when the tube pump 12 starts the suction operation in a stationary state is described, referring to FIGS. 7A to 7C. FIG. 7A illustrates a stationary state in which the tube pump 12 in the present exemplary embodiment is not in operation. The tube pump 12 moves the roller member 23 to the state of releasing the pressing of the tube 22 so that after the suction operation, the pressing force does not continuously act to cause deformation of the tube 22, and then enters a stationary state. Thus, in the stationary state after the suction operation shown in FIG. 7A, a plurality of bosses 25*c* of the drive rotating body 25 are positioned in the vicinity of the end portion 24Ac2 in a reverse rotation (clockwise) direction in the engagement hole 24Ac of the roller holding member 24. In addition, the cam surface 25*a* of the drive rotating body 25 is present in the vicinity of the second position, in the elongated hole 24Ab of the roller holding rotating member 24 guiding the movement of the roller member 23. Thus, the roller member 23 moves to the position releasing the pressing force to the tube 22.

FIG. 7B illustrates a state immediately after the drive rotating body 25 starts the left rotation (counterclockwise) which is a rotation direction at the time of suction operation of the tube pump 12, in the stationary state shown in FIG. 7A.

The boss 25*c* of the drive rotating body 25 moves away from the end portion 24Ac2 contacting and pressing the engagement hole 24Ac of the roller holding member 24 in the right rotation direction, toward the end portion 24Ac1 contacting and pressing it in the left rotation direction. In the state of FIG. 7B, since the boss 25*c* is not in contact with any end portion 24Ac1 or 24Ac2, the driving force of the left rotation direction of the drive rotating body 25 is not transmitted to the roller holding member 24. Meanwhile, the position of the cam surface 25*a* of the drive rotating body 25 in the elongated hole 24Ab of the roller holding member 24 is moved in a direction of approaching the roller member 23 to the tube, that is, toward the first position where the roller member 23 presses the tube 22 in the second position (see FIG. 7A).

As the left rotation of the drive rotating body 25 which is a suction operation direction of the tube pump 12 proceeds, the cam surface 25*a* reaches the first position, and as a result, in the tube position 22*a*, the tube 22 is in the state of being pressed until the inner wall comes into close contact by the roller member 23. As the left rotation of the drive rotating body 25 further proceeds, the boss 25*c* of the drive rotating body 25 reaches and hits the end portion 24Ac1 in the left rotation direction of the engagement hole 24Ac, thereby reaching the state that the driving force of the left rotation direction of the drive rotating body 25 is transmitted to the roller holding rotating member 24.

First, it has been described that the rotation angle of the rotor required for the roller member 23 to move from the second position to the first position by the cam surface 25*a* is smaller than the formation angle of the engagement holes 24Ac and 24Bc (not shown) in the rotation direction provided on the two plane members of the roller holding member 24 which is the dead zone of the drive transmitting part. As such, the timing at which the cam surface 25*a* reaches the first position and performs the pressing of the tube 22 by the roller member 23 is set to be certainly earlier than the timing at which the boss 25*c* reaches the end portion 24Ac1 in the left rotation direction and the roller holding member 24 starts the left rotation. In addition, the relative dimensions of the components are set so that the timing is certainly ahead of the timing at which the roller holding member 24 starts the left rotation. The left rotation described herein refers to a rotation movement of the roller member 23 held by the roller holding member 24 around the drive shaft 25*b*. In addition, though it has been described that the distance of the cam surface 25*a* from the drive shaft 25*b* is formed to be slowly changed with the predetermined rotation angle, it is preferred to set the distance to be constant immediately before the boss 25*c* abuts on the engagement hole 24Ac. This is for allowing the roller member 23 to press the tube 22 at an appropriate position, considering a component tolerance and the like.

In the state that the cam surface 25*a* reaches the first position, the tube side end 24Ab1 of the elongated hole 24Ab represented shown in FIG. 6 is set to be at the position not being in contact with the rotating shaft 23*b* of the roller member 23. This is for not interfering with the function of the cam surface 25*a*.

FIG. 7C illustrates that the boss 25*c* reaches end portion 24Ac1 which the boss hits at the time of rotation of the engagement hole 24Ac in a left rotation direction, and the driving force of the drive rotating body 25 in a left rotation direction is transmitted to the roller holding member 24, so that the roller holding member 24 and the drive rotating body 25 rotate in a left rotation direction, that is, a suction operation direction. As a result, the roller holding member 24 rotates in the state that the roller member 23 presses the tube 22 until the inner walls are in close contact with each other, and further the portion where the inner walls of the tube 22 are in close contact with each other is moved in a rotation direction due to the circulation of the roller member 23, thereby generating negative pressure behind the pressed position 22*a* of the tube 22 in a rotation direction. That is, the tube pump 12 functions as a suction pump.

Next, the operation of each part when the rotation direction of the drive rotating body 25 of the tube pump 12 is reversed (changed) from a left rotation which is the rotation direction at the time of the suction operation to a right rotation which is the direction of releasing the pressing of the tube 22 by the roller member 23 is described, referring to FIGS. 7D and 7E.

When the rotation in the left rotation direction performing the suction operation described in FIGS. 7B and 7C is stopped, and the drive rotating body 25 starts a right rotation (clockwise), the boss 25*c* of the drive rotating body 25 starts to move away from the end portion 24Ac1 which the boss hits at the time of the left rotation of the engagement hole 24Ac of the roller holding rotating member 24, in the direction of the end portion 24Ac2 on the opposite side.

Figure 8:
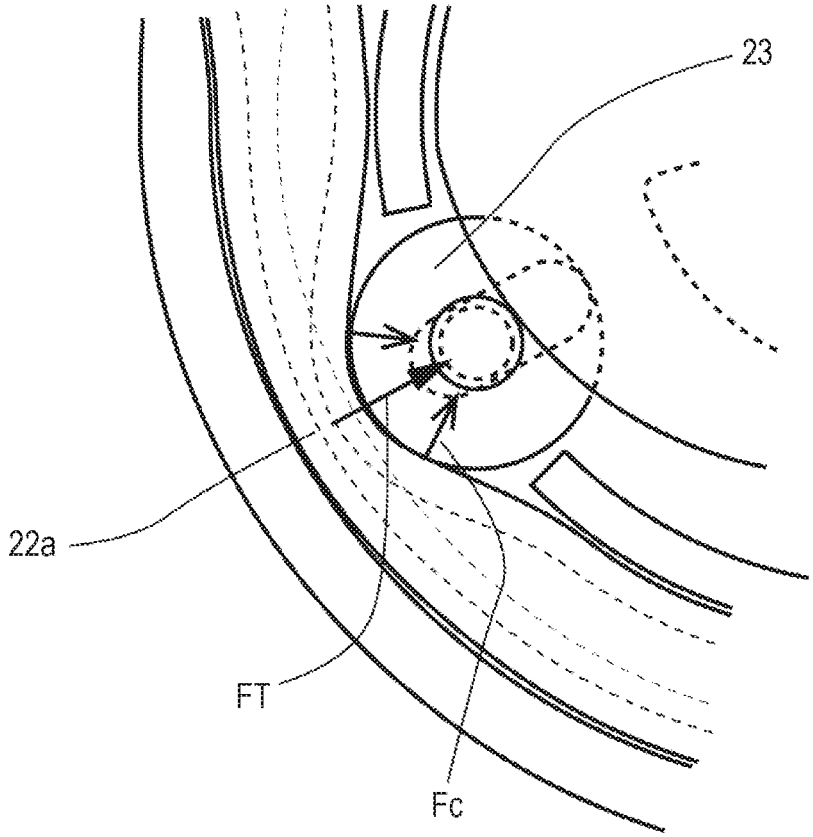
FIG. 8 is a drawing representing reaction force of a tube to a roller member of the tube pump of a first exemplary embodiment.

Here, the tube 22 is in the state of being pressed between the roller member 23 and the wall surface 21*a* of the case 21 by the roller member 23, and as shown in FIG. 8, presses the roller member 23 in the direction of the drive shaft 25*b* of the drive rotating body 25 by the force (FT) to return to the original shape. In addition, since the tube 22 is deformed by both sides of the pressed position 22*a*, it presses the roller member 23 in the center direction of the cylindrical part 23*a*, by the restoring force (Fc). That is, the roller member 23 receives force in the center direction of the drive shaft 25*b* from the tube 22, and at the same time receives force from the tube 22 so that the position of the rotation direction centered on the drive shaft 25*b* is not moved.

In addition, in order that the roller member 23 is moved from the tube pressed position 22*a* to the adjacent position 22*b* in the rotation direction, it is necessary to press the tube 22 at the position 22*b* against the repulsive force of the tube 22. However, since the rotation drive of the drive rotating body 25 is not transmitted to the roller holding rotating member 24, the roller holding rotating member 24 does not rotate with the drive rotating body 25, and the roller member maintains the reverse starting position of the drive rotating body 25.

As the right rotation of the drive rotating body 25 proceeds, the cam surface 25*a* which is a position acting part of the roller member 23 of the drive rotating body 25 moves in the direction of the drive shaft 25*b*, whereby an abutting position of the roller member 23 which has been stopped with the shaft part 23*c* moves in the center direction of the drive shaft 25*b*. Therefore, the roller member 23 moves the guide hole 24Ab provided on the roller holding rotating member 24 in a pump rotation center direction, that is, a direction of releasing the pressed state of the tube, by the restoring force of the tube.

In addition, as the right rotation of the drive rotating body 25 proceeds, the boss 25*c* of the drive rotating body 25 abuts on the end portion 24Ac2 of the engagement hole 24Ac formed on the roller holding member 24, as shown in FIG. 7E. As a result, the driving force of the drive rotating body 25 is transmitted to the roller holding member 24, and the roller holding member 24 starts to rotate in a reverse direction. At this point, the cam surface 25*a* of the drive rotating body 25 moves to the position where the roller member 23 does not press the tube 22. Therefore, the roller member 23 does not press the tube 22, and the tube pump 12 does not function as the suction pump, even in the case that the roller member 23 does not press the tube 22, and the roller member 23 moves in the right rotation direction with the right rotation of the roller holding member 24.

In the right rotation direction also, by the configuration that the rotation angle of the rotor required to move the cam surface 25*a* as described above from the first position to the second position is smaller than the formation angle of the engagement hole 24Ac or 24Bc (not shown) in the rotation direction provided on the two plane members of the roller holding member 24 which is the dead zone of the drive transmitting part, the timing at which release of the pressing of the tube 22 is performed by the roller member 23 is certainly ahead of the timing at which the right rotation of the roller holding member 24, that is, the rotational movement centered on the drive shaft 25*b* of the roller member 23 held by the roller holding member 24 is started.

First, the position of the cam surface where the roller member 23 releases the pressing of the tube 22 was defined as a second position. As the position, any position is fine as long as the roller member 23 is moved in the direction of the drive shaft 25*b* which is the rotor rotation center by the restoring force of the tube to release the close contact state of the tube inner wall at the position; however, for the purpose of decreasing the load of a rotational driving source, the position where the tube can be present as a natural body is preferred.

In addition, when the condition is satisfied in this state, the rotating shaft 23*b* of the roller member 23 abuts on the end portion 24Ab2 on the drive shaft 25*b* side of the guide hole 24Ab of the roller holding rotating member 24, whereby the cam surface 25*a* and the shaft part 23*c* of the roller member may be separated from each other.

(Effects)

As described above, the tube pump 12 of the present exemplary embodiment has the configuration that when the drive shaft 25*b* rotates in the reverse direction from the rotation direction of the suction operation, using the restoring force of the tube 22, the release of the pressed state of the tube 22 is certainly performed by the roller member 23, and then the rotational movement centered on the drive shaft 25*b* of the roller member 23 is performed. Therefore, a tube pump which does not produce a reverse flow of ink, and positive pressure in the tube 22, and furthermore, in the cap 8, when being reversed from the suction direction to the reverse direction with a simple configuration to start rotation can be provided.

In addition, since in the suction operation also, the roller member 23 rotates and moves on the tube 22 after performing the pressing of the tube 22 by the roller member 23, the start position of the suction to the rotation of the drive shaft 25*b* can be accurately grasped, and a tube pump which can easily set the suction operation parameters accurately can be provided.

Thus, the inkjet recording apparatus 100 of the present exemplary embodiment can perform the maintenance operation by the maintenance unit 1, by a simple configuration.

Second Exemplary Embodiment

Next, a second exemplary embodiment is described referring to FIGS. 9 to 11E.

(Configuration of Tube Pump)

Figure 9:
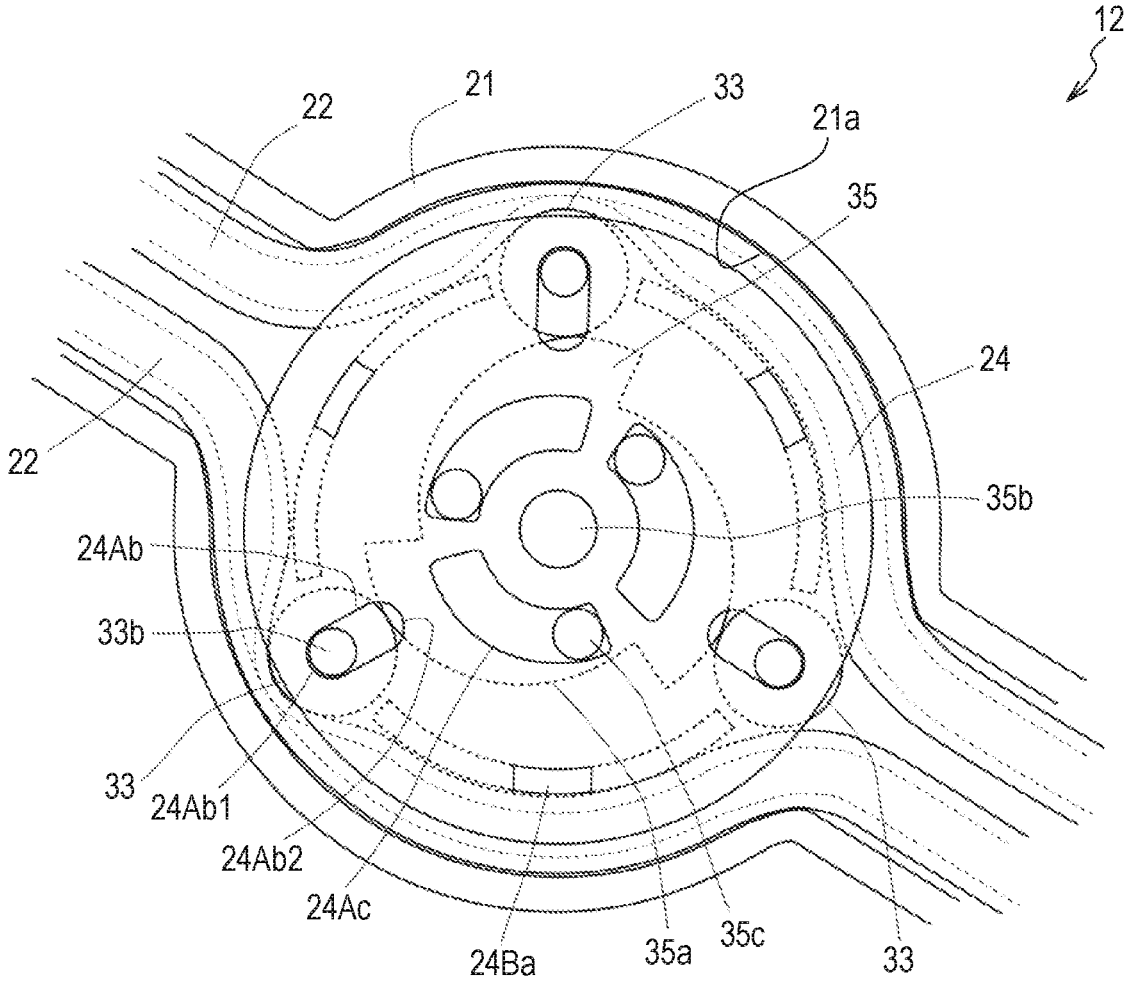
FIG. 9 is a drawing representing a configuration of the tube pump of a second exemplary embodiment.
Figure 10:
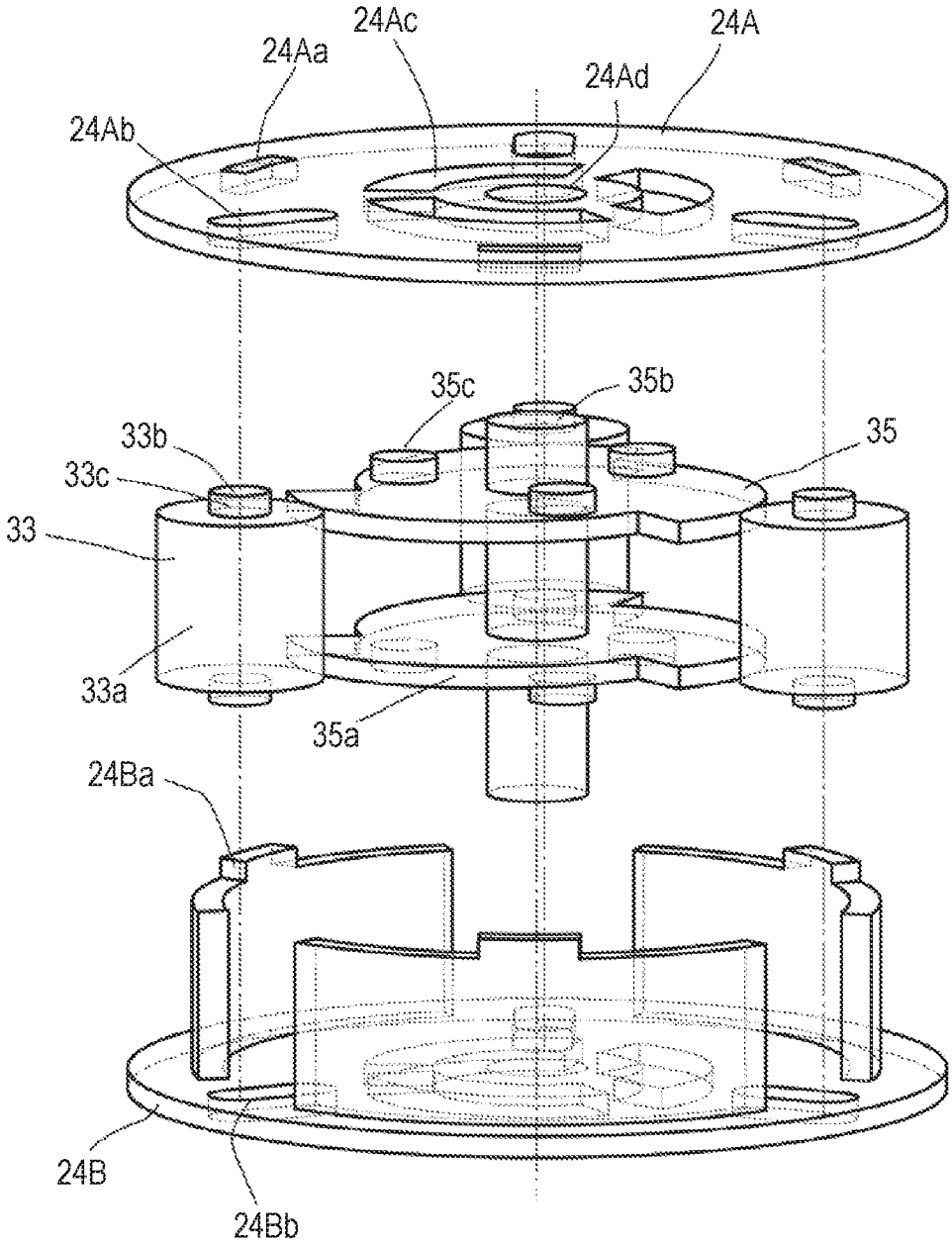
FIG. 10 is an exploded perspective view of a part of the tube pump of a second exemplary embodiment.

FIG. 9 is a schematic configuration diagram representing the overall tube pump 12, and FIG. 10 is a configuration diagram representing the component configuration of the rotor rotating inside the tube pump 12. Reference numeral 24 is the roller holding rotating member which is identical to that of the first exemplary embodiment, and 33 is a roller member having the cylindrical surface 33*a* for pressing the tube, and the rotating shaft 33*b* which is a mounting section to the roller holding rotating member 24. The roller member 33 is supported by engaging the rotating shaft 33*b* with the elongated hole 24Ab on the roller holding rotating member 24, as in the first exemplary embodiment.

Reference numeral 35 is the drive rotating body, and has a boss 35*c* which is an engagement portion for transmitting the rotation drive of the drive shaft 35*b* driven by a driving source which is not shown to the roller holding rotating member 24, as in the first exemplary embodiment. The boss 35*c* is engaged with the engagement hole 24Ac provided on the member 24A of the roller holding rotating member 24, and the engagement hole (not shown) provided on the member 24B, thereby transmitting the rotation drive of the drive rotating body 35 to the roller holding rotating member 24.

The drive transmission function of the boss 35*c* of the drive rotating body 35 and the engagement hole 24Ac of the roller holding rotating member 24 is identical to that of the boss 25*c* of the drive rotating body and the engagement hole 24Ac of the roller holding rotating member 24 in the first exemplary embodiment. When the rotation of the drive rotating body 35 is reversed, the rotation drive of the drive rotating body 35 is not transmitted to the roller holding rotating member 24, until the boss 35*c* of the drive rotating body 35 reaches the end portion on the opposite side of the engagement hole.

In addition, the drive rotating body 35 acts on the cylindrical surface 33*a* performing the tube pressing of the roller member 33, thereby having a cam surface 35*a* defining the position of the end portion on the rotor rotation center side in the movable range of the roller member 33 in the elongated holes 24Ab and 24Bb of the roller holding rotating member 24.

The elongated hole 24Ab is for guiding the roller member 33 movably from the tube side end 24Ab1 of the elongated hole 24Ab to the end portion 24Ab2 on the rotor rotation center side, as in the first exemplary embodiment. However, the cam surface 35*a* acts on the cylindrical surface 33*a* of the roller member 33, thereby serving to determine the movement range on the rotor rotation center side of the rotating shaft 33*b* of the roller member 33 in the guide hole 24Ab. That is, even in the case that the rotating shaft 33*b* of the roller member 33 does not reach the end portion 24Ab2 on the rotor rotation center side of the elongated hole 24Ab, when the cylindrical surface 33*a* of the roller member 33 reaches the cam surface 35*a*, the roller member 33 does not move in the direction of the rotor rotation center any more.

The position of the cam surface 35*a* is changed from the first position where the roller member 33 presses the tube 22 to the second position where the tube pressing by the roller member can be released by the repulsive force to the tube pressing, in the angular range where the boss 35*c* of the drive rotating body which is a drive connecting part of the drive rotating body 35 and the roller holding rotating member 24 moves from one end portion of the engagement hole 24Ac of the roller holding member 24 to the other end portion thereof.

The cam surface 35*a* is formed of a surface in which the distance from the drive shaft 35*b* center which is the rotor center is gradually changed with the predetermined rotation angle so that the distance is defined from the second position to the first position. Like the first exemplary embodiment, the rotation angle of the rotor required for the roller member 33 to move from the second position to the first position by the cam surface 35*a* is smaller than the formation angle of the engagement holes 24Ac and 24Bc (not shown) in the rotation direction provided on the two plane members of the roller holding member 24 which is the dead zone.

(Operation of Tube Pump)

Next, movements of the roller member 33, the roller holding rotating member 24, and the drive rotating body 35 in each operation in the tube pump 12 of the exemplary embodiment are described, referring to FIGS. 11A, 11B, 11C, 11D, and 11E. As in the first exemplary embodiment, rotation direction of the drive rotating body 25 is defined so that the left rotation (counterclockwise) direction is used as a suction operation, and the right rotation (clockwise) direction is used as the pressing release of the tube 22, in each drawing.

Figure 11A:
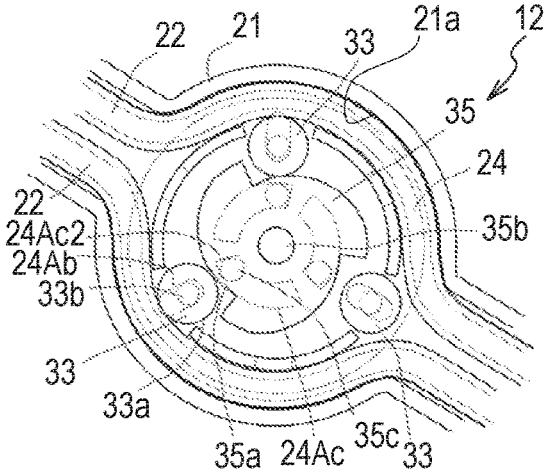
FIGS. 11A, 11B, 11C, 11D, and 11E are drawings representing the operation of each member of the tube pump of a second exemplary embodiment.

FIG. 11A is a drawing representing that after the suction operation, the tube pump 12 of the present exemplary embodiment operates until it releases the pressing of the tube 22 of the roller member 33, and then stops, as in the first exemplary embodiment.

In the stationary state, as in the first exemplary embodiment, the boss 35*c* of the drive rotating body 35 is positioned in the vicinity of the end portion 24Ac2 in the right direction (clockwise) in the engagement hole 24Ac of the roller holding rotating member 24. In addition, the cam surface 35*a* is present near the second position. Thus, the roller member 33 moves to the position where the pressing force to the tube 22 is released.

Figure 11D:
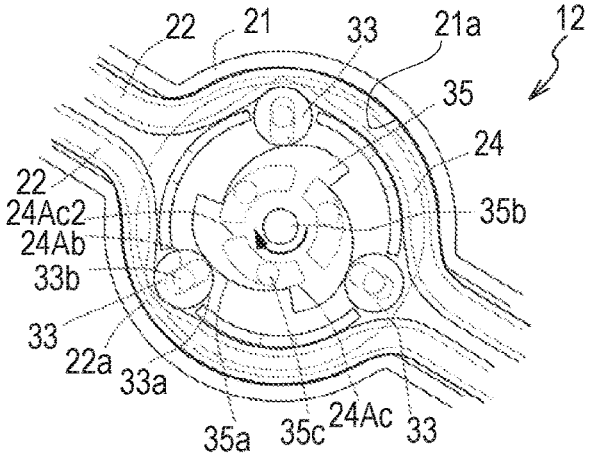
Figure 11B:
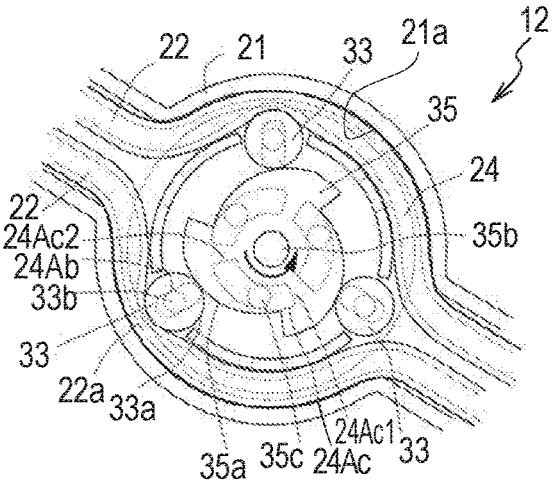
Figure 11E:
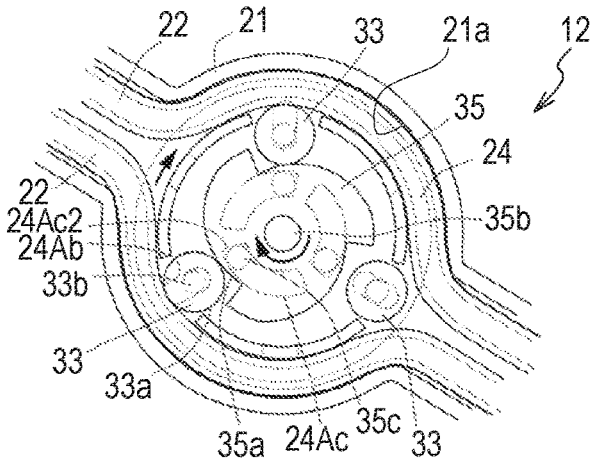
Figure 11C:
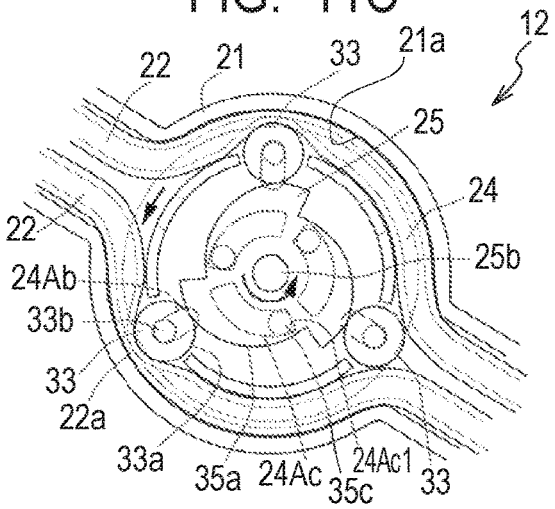

FIG. 11B is a drawing representing that the drive rotating body 35 starts the left rotation (counterclockwise) which is the suction operation direction of the tube pump, in the stationary state of FIG. 11C.

As in the first exemplary embodiment, since the boss 35*c* of the drive rotating body 35 starts to move away from the end portion 24Ac2 in the right rotation direction of the engagement hole 24Ac, toward the end portion 24Ac1 in the left rotation direction, and does not hit both of the end portions, the driving force of the left rotation is not transmitted to the roller holding rotating member 24.

Meanwhile, the position of the cam surface 35*a* of the drive rotating body 35 starts to move toward the first position where the roller member 33 presses the tube 22 from the second position. By the positional change of the cam surface 35*a*, the roller member 33 gradually moves to the position pressing the tube 22, in the tube position 22*a*.

As the left rotation of the drive rotating body 35 proceeds, the cam surface 35*a* reaches the first position, and in the tube position 22*a*, the tube 22 is in the state of being pressed by the roller member 33, until the inner wall is in close contact therewith. The boss 35*c* of the drive rotating body 35 reaches and hits the end portion 24Ac1 in the left rotation direction of the engagement hole 24Ac, thereby being in the state of transmitting the driving force in the left rotation direction of the drive rotating body 35 to the roller holding rotating member 24.

First, for the cam surface 35*a*, it has been described that the rotation angle of the rotor required for the roller member 33 to move from the second position to the first position is smaller than the formation angle of the engagement holes 24Ac and 24Bc in the rotation direction provided on the two plane members of the roller holding member 24 which is the dead zone of the drive transmitting part. Here, the relative dimension of the component parts is set so that the timing at which the cam surface 35*a* reaches the first position and the pressing of the tube 22 by the roller member 33 is performed is certainly ahead of the timing at which the boss 35*c* reaches the end portion 24Ac1 in the left rotation direction and the roller holding member 24 starts the rotational movement, that is, the roller member 33 held by the roller holding member 24 starts the rotational movement centered on drive shaft 35*b*.

In addition, though it has been described that the distance from the drive shaft 35*b* of the cam surface 35*a* is formed to be gradually changed with a predetermined rotation angle, it is preferred to set that the boss 35*c* becomes constant immediately before it abuts on the engagement hole 24Ac. This is for allowing the roller member 23 to press the tube 22 at an appropriate position, considering a component tolerance and the like.

When the cam surface 35*a* reaches the first position, the tube side end 24Ab1 of the elongated hole 24Ab shown in FIG. 6 is set at the position where it is not in contact with the rotating shaft 33*b* of the roller member 33. This is for not interfering with the function of the cam surface 35*a*.

FIG. 11C illustrates that the boss 35*c* reaches the end portion 24Ac1 which the boss hits at the time of rotating in the left rotation direction of the engagement hole 24Ac, and the driving force in the left rotation direction of the drive rotating body 35 is transmitted to the roller holding member 24, so that the roller holding member 24 and the drive rotating body 35 rotate in the left rotation direction, that is the suction operation direction. As a result, the roller holding member 24 rotates in the state that the roller member 23 presses the tube 22 until the inner walls are in close contact with each other, and further following the circulation of the roller member 33, the region where the inner walls of the tube 22 are in close contact with each other is moved in the rotation direction. Therefore, negative pressure is generated behind the pressed position 22*a* of the tube 22 in the rotation direction. That is, the tube pump 12 functions as a suction pump.

Next, the operation of each part when the rotation direction of the drive rotating body 35 of the tube pump 12 is reversed from the left rotation which is the rotation direction at the time of the suction operation to the right rotation which is the direction to release the pressing of the tube 22 by the roller member 33 is also described, referring to FIGS. 11D and 11E.

When the rotation in the left rotation direction to perform the suction operation described in FIGS. 11B and 11C is stopped, and the drive rotating body 35 starts the right rotation (clockwise), the boss 35*c* of the drive rotating body 35 moves in the direction of the end portion 24Ac2 on the opposite side, away from the end portion 24Ac1, as in the first exemplary embodiment.

Here, as in the first exemplary embodiment, the roller member 33 receives force from the tube 22 so that the position in the rotation direction centered on the drive shaft 35*b* does not move, and maintains the reverse starting position of the drive rotating body 35.

As the right rotation of the drive rotating body 35 proceeds, the cam surface 35*a* which is the position acting part of the roller member 33 of the drive rotating body 35 moves in the direction of the drive shaft 35*b*, and thus, the abutting position of the stopped roller member 33 with the shaft part 33*c* moves in the center direction of the drive shaft 35*b*. Thus, the roller member 33 moves the guide hole 24Ab provided on the roller holding rotating member 24 in the pump rotation center direction, that is, in the direction to release the pressed state of the tube, by the restoring force of the tube.

In addition, as the right rotation of the drive rotating body 35 proceeds, the boss 35*c* of the drive rotating body 35 abuts on the end portion 24Ac2 of the engagement hole 24Ac formed on the roller holding member 24, as shown in FIG. 11E. As a result, the driving force of the drive rotating body 35 is transmitted to the roller holding member 24, so that the roller holding member 24 starts reverse rotation. Then, at this point, the cam surface 35*a* moves to the position where the roller member 33 does not press the tube 22, as in the first exemplary embodiment. Therefore, even in the case that the roller member 33 moves in the right rotation direction, following the right rotation of the roller holding member 24, the tube pump 12 does not function as a suction pump.

In the right rotation direction also, the movement rotation angle from the first position to the second position of the cam surface 35*a* is smaller than the formation angle of the engagement holes 24Ac and 24Bc (not shown) in the rotation direction which is the dead zone of the drive transmitting part, as in the first exemplary embodiment. By this configuration, the timing at which the release of pressing of the tube 22 by the roller member 33 is performed is certainly ahead of the timing at which the right rotation of the roller holding member 24, that is, the rotational movement centered on the drive shaft 35*b* of the roller member 33 held by the roller holding member 24 is started.

First, though the position of the cam surface where the roller member 33 releases the pressing of the tube 22 is set as the second position, any position is fine as long as the close contact state of the tube inner wall is released at the position, as in first exemplary embodiment, but the position where the tube can be present as a natural body is preferred.

In addition, when the conditions are satisfied in this state, the rotating shaft 33*b* of the roller member 33 abuts on the end portion 24Ab2 on the drive shaft 35*b* side of the guide hole 24Ab of the roller holding rotating member 24, so that the cam surface 35*a* and the shaft part 33*c* of the roller member may be separated.

(Effects)

In the first exemplary embodiment, the cam surface 25*a* of the drive rotating body 25 abuts on the shaft part by setting the shaft part 23*c* in the roller member 23. However, in the present second exemplary embodiment, the cam surface 35*a* of the drive rotating body 35 abuts on the cylindrical surface 33*a* pressing the tube of the roller member 33. By taking this configuration, the number of dimensions related to the calculation of the position of the roller member 33 pressing the tube 22 in the center of the drive shaft 35*b* which is the rotor rotation center can be reduced. As a result, it is possible to reduce variations in the compression amount of the tube 22 by the roller member 33, and to generate more stable negative pressure.

In addition, in the roller member 33, since it is not necessary to prepare the action part by the cam surface 35*a* of the drive rotating body 35 separately, the thickness of the entire rotor can be reduced, so that the size of the entire pump can be smaller.

Other effects are identical to those in the case of the first exemplary embodiment.

Third Exemplary Embodiment

Next, the third exemplary embodiment of the tube pump of the present invention is described, referring to FIGS. 12 to 15E.

(Configuration of Tube Pump)

Figure 12:
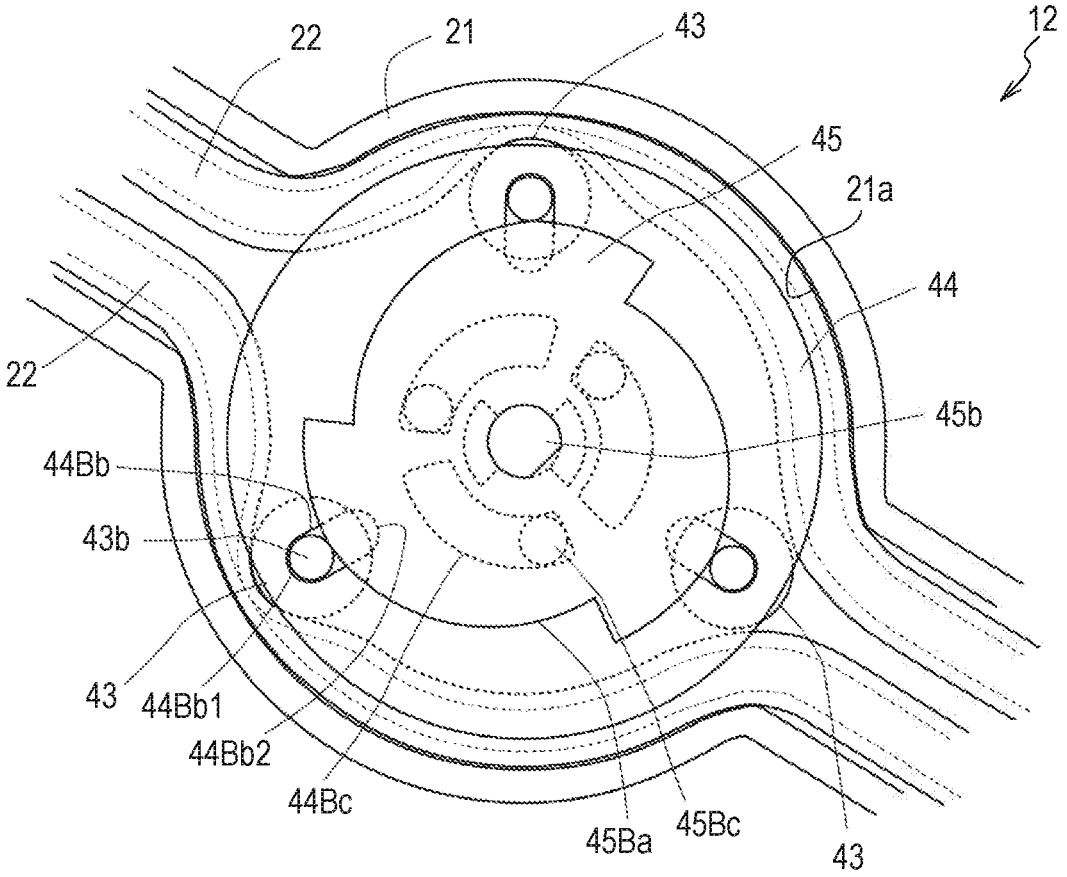
FIG. 12 is a drawing representing a configuration of the tube pump of a third exemplary embodiment.
Figure 13:
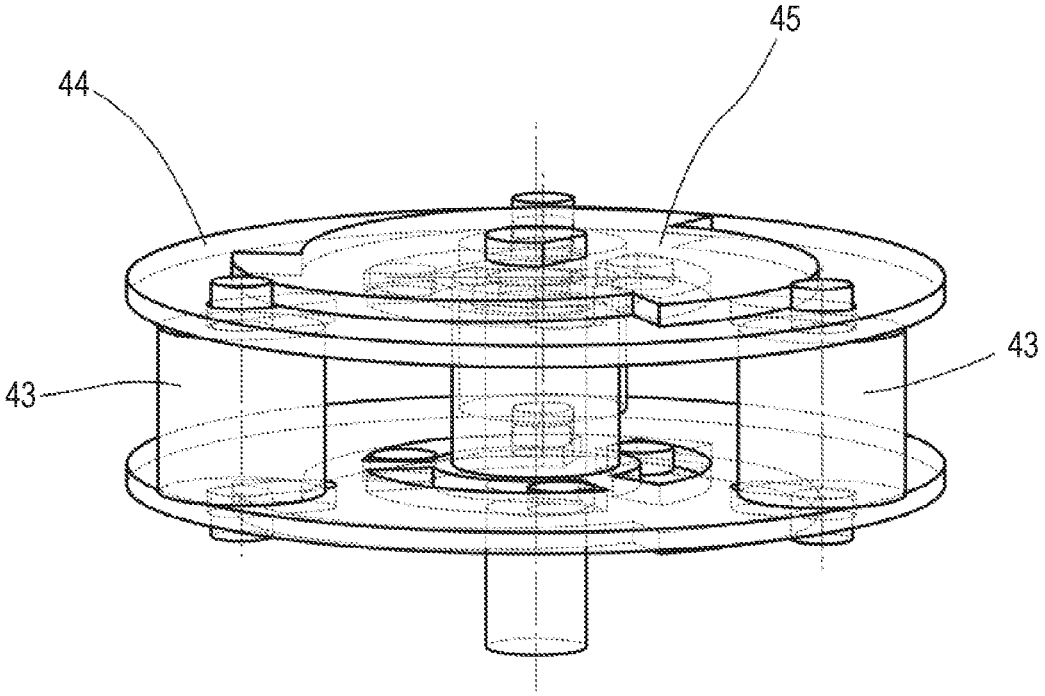
FIG. 13 is a perspective view of a part of the tube pump of a third exemplary embodiment.
Figure 14:
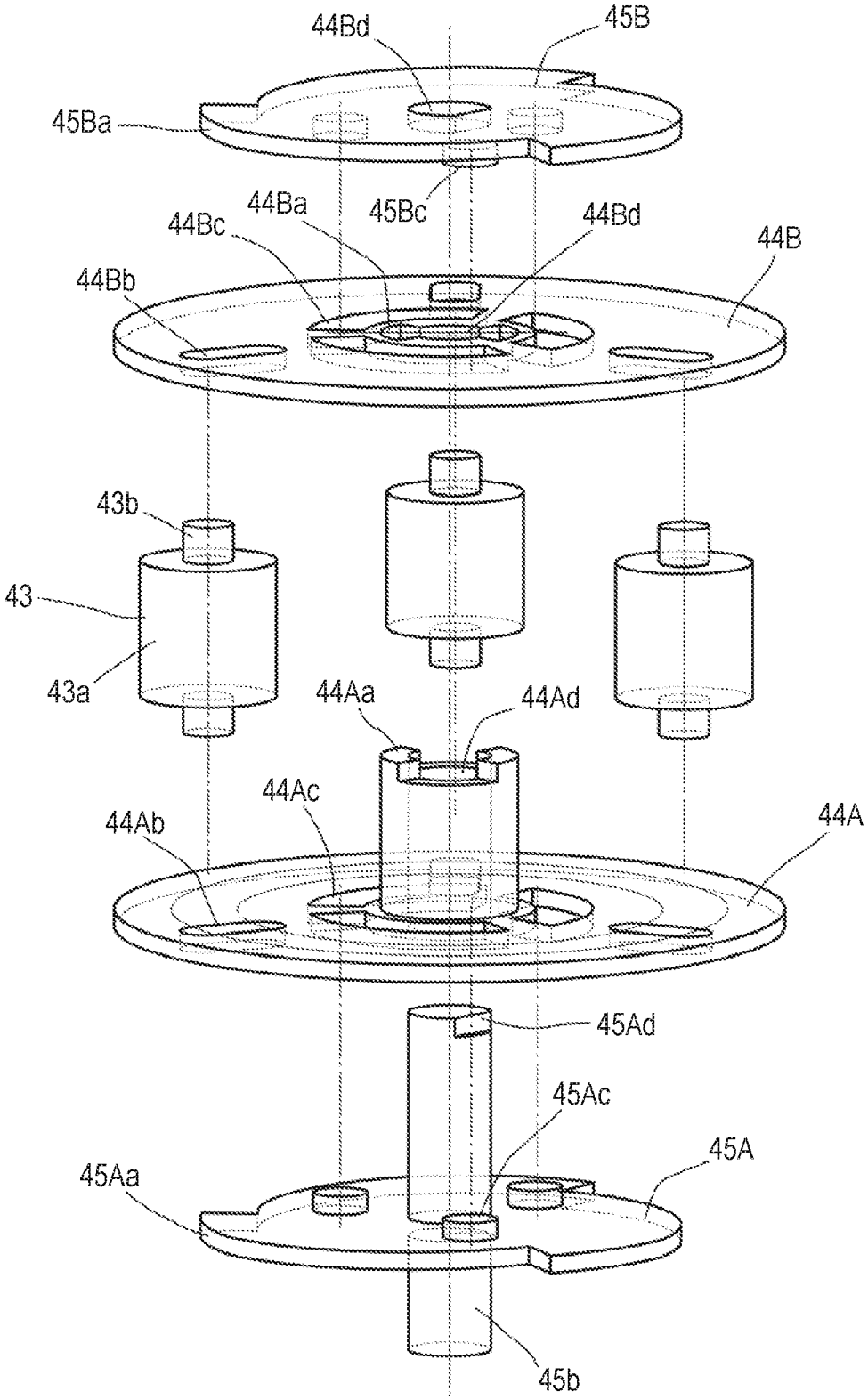
FIG. 14 is an exploded perspective view of a part of the tube pump of a third exemplary embodiment.

FIG. 12 is a schematic configuration diagram of the overall tube pump 12 of the third exemplary embodiment, FIG. 13 is a drawing representing the appearance of the rotor which rotates while pressing the tube 22 to generate negative pressure, or rotates in the state of not pressing the tube, and FIG. 14 is a configuration diagram representing the configuration of the rotor.

The tube pump 12 of the present third exemplary embodiment includes a case 21; a tube 22; a roller member 43 (an example of a roller) forming the rotor; a roller holding member 44 (an example of a first rotating body); and a drive rotating body 45 (an example of a second rotating body). Here, the case 21 and the tube 22 are the members having the same functions and shapes as those in the first exemplary embodiment. However, unlike the first exemplary embodiment, the drive rotating body 45 is positioned on the outer side of the roller holding rotating member 44, so that the cam surfaces 45Aa and 45Ba act on the rotating shaft 43*b* of the roller member 43, on the outer side of the roller holding rotating member 44.

The roller holding rotating member 44 is composed of two members 44A and 44B, while reference numeral 44A has a shape of a combination of a flat plate and a cylinder, and reference numeral 44B is a flat plate-shaped member. A joining part 44Aa provided on the cylindrical part of 44A and 44Ba of 44B are joined, whereby they can rotate integrally. The flat plate part of the two members have the elongated holes 44Ab and 44Bb for being engaged with the rotating shaft 43*b* of the roller member 43 and maintained, as in the first exemplary embodiment. The elongated holes 44Ab and 44Bb are formed to have a predetermined length toward the pump rotation center in the outer periphery of the roller holding rotating member 44, and the roller member is movable therein.

The drive rotating body 45 is disposed in the case 21, and as shown in FIGS. 13 and 14, composed of two members 45A and 45B. In addition, the drive shaft 45*b* provided on the member 45A is passed through 44Bd provided on a bearing holes 44Ad and 44B provided on the cylindrical part of 44A which is the member of the roller holding rotating member 44, and the roller holding rotating member 44 is sandwiched therebetween, thereby joining the two joining parts 45Ad and 44Bd provided on the two members. The two members can rotate integrally. In addition, it is driven by the driving force imparted to the drive shaft 45*b* which is the rotating shaft of the rotor from the driving source (not shown), and rotates.

The drive rotating body 45 has bosses 45Ac and 45Bc (an example of protrusion) formed thereon which is an engagement portion for transmitting the driving force of the drive rotating body 45 on the two flat plates to the roller holding member 44, as in the first exemplary embodiment, as shown in FIG. 14. In addition, the roller holding member also has the engagement holes 44Ac and 44Bc formed thereon which are engaged with the bosses 45Ac and 45Bc. The structure of the drive transmission and setting a dead zone are identical to those in the first exemplary embodiment.

The drive rotating body 45 has cam surfaces 45Aa and 45Ba, and the cam surface acts on the rotating shaft 43*b* of the roller member 43 protruding from the elongated holes 44Ab and 44Bb of the roller holding rotating member 44 toward the drive rotating body 45. In addition, the drive rotating body 45 acts in the movable range of the rotating shaft 43*b* in the elongated holes 44Ab and 44Bb. These are identical to those in the first exemplary embodiment.

It is also identical to the first exemplary embodiment that the cam surfaces 45Aa and 45Ba are gradually changed from the first position near the tube side end of the elongated hole 44Ab, where the roller member 43 presses the tube 22 between the roller member and the wall surface 21*a* of the case 21 by the action of the cam surfaces 45Aa and 45Ba, to the second position near the rotor center side end of the elongated hole 44Ab, where the pressing can be released by the repulsive force to the pressing of the tube 22. In addition, it is also identical to the first exemplary embodiment that the rotation angle of the rotor required for the roller member 43 to move from the second position to the first position by the cam surfaces 45Aa and 45Ba is smaller than the formation angle of the engagement holes 44Ac and 44Bc in the rotation direction provided on the two plane members of the roller holding member 44 which is the dead zone of the drive transmitting part as described above.

(Operation of Tube Pump)

Figure 15A:
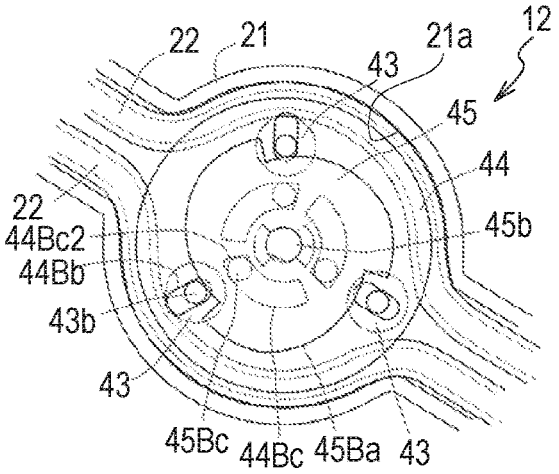
FIGS. 15A, 15B, 15C, 15D, and 15E are drawings representing the operation of each member of the tube pump of a third exemplary embodiment.
Figure 15D:
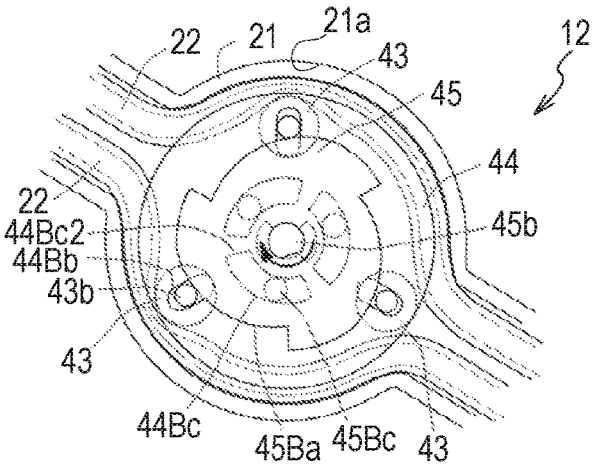
Figure 15B:
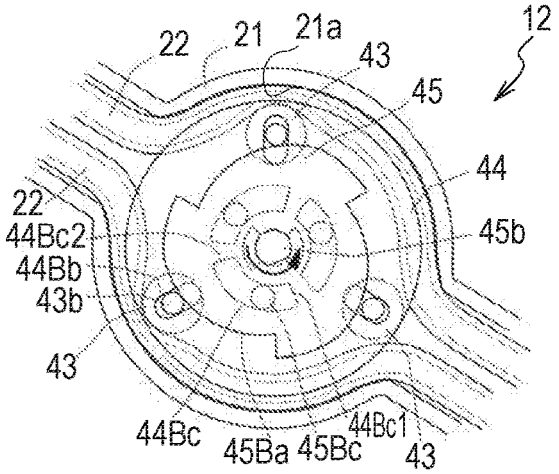
Figure 15E:
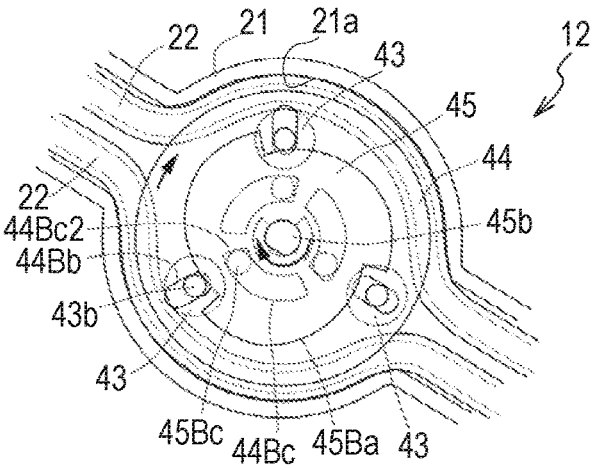
Figure 15C:
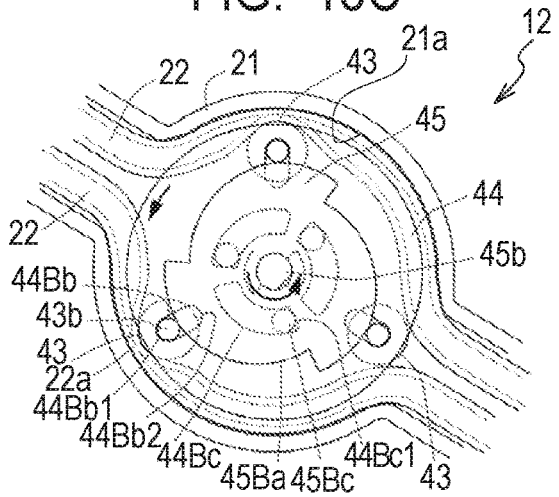

Next, the operations of the roller member 43, the roller holding rotating member 44, and the drive rotating body 45 according to the rotation direction of the tube pump of the present exemplary embodiment are described, referring to FIGS. 15A, 15B, and 15C.

As in the first exemplary embodiment, a rotation direction in which the left rotation (counterclockwise) direction of the drive rotating body 45 is used as the suction operation, and the right rotation (clockwise) direction thereof is used as release of the pressing of the tube 22 is shown in each drawing.

First, the operation of each part when the tube pump 12 of the present exemplary embodiment starts the suction operation in the stationary state is described, referring to FIGS. 15A, 15B, and 15C.

FIG. 15A illustrates a stationary state that the tube pump 12 in the present exemplary embodiment does not operate. As in the first exemplary embodiment, the tube pump 12 moves the roller member 43 to the state of releasing the pressing of the tube 22 so that the pressing force does not continuously act to cause deformation of the tube 22, after the suction operation, and then enters a stationary state. Thus, in the stationary state after the suction operation shown in FIG. 15A, as in the first exemplary embodiment, the cam surface 45Ba is present near the second position, and the roller member 43 moves to the position where the pressing force to the tube 22 is released.

FIG. 15B illustrates the state immediately after the drive rotating body 45 starts the left rotation (counterclockwise) which is the rotation direction at the time of the suction operation of the tube pump 12, in the stationary state shown in FIG. 15A.

The boss 45Bc of the drive rotating body 45 moves away from the end portion 44Bc2 contacting and pressing the engagement hole 44Bc of the roller holding member 44 in the right rotation direction, toward the end portion 44Bc1 contacting and pressing it in the left rotation direction.

As in the first exemplary embodiment, in the state of FIG. 15B, since the boss 45Bc is not in contact with any side of the end portions, the driving force in the left rotation direction of the drive rotating body 45 is not transmitted to the roller holding member 44. Meanwhile, the position of the cam surface 45Ba moves from the second position to the first position.

As the left rotation of the drive rotating body 45 which is the suction operation direction of the tube pump 12 proceeds, the cam surface 45Ba reaches the first position, and as a result, at the tube position 22*a*, the tube 22 is in the state of being pressed by the roller member 43 until the inner wall is in close contact therewith.

As the left rotation of the drive rotating body 45 further proceeds, the boss 45Bc reaches and hits the end portion 44Bc1 in the left rotation direction of the engagement hole 44Bc, thereby reaching the state that the driving force of the left rotation direction of the drive rotating body 45 is transmitted to the roller holding rotating member 44.

As in the first exemplary embodiment, in respect to the relationship between the rotation angle required to move from the second position to the first position of the cam surface 45*a*, and the formation angle of the dead zone of the drive transmitting part, the timing at which the tube 22 is pressed by the roller member 43 with the action of the cam surface 45Ba is certainly ahead of the timing at which the roller holding member 44 starts the left rotation, that is, the roller member 43 held by the roller holding member 44 starts the rotational movement centered on the drive shaft 45*b*.

In addition, as in the first exemplary embodiment, it is preferred that the cam surface 45Ba is set to be constant immediately before the boss 45Bc abuts on the engagement hole 44Bc.

In the state that the cam surface 45Ba reaches the first position, the tube side end of the elongated hole 44Ab is set to be at the position not contacting the rotating shaft 43*b* of the roller member 43.

FIG. 15C illustrates that the boss 45Bc reaches the end portion 44Bc1 on which the boss abuts at the time of rotation in the left rotation direction of the engagement hole 44Bc, and the driving force in the left rotation direction of the drive rotating body 45 is transmitted to the roller holding member 44, so that the roller holding member 44 and the drive rotating body 45 rotate in the left rotation direction, that is, in the suction operation direction.

As a result, as in the first exemplary embodiment, since the roller member 43 circulates in the state of pressing the tube 22, negative pressure is generated behind the pressed position 22*a* of the tube 22 in the rotation direction, and the tube pump 12 functions as a suction pump.

Next, the operation of each part when the rotation direction of the drive rotating body 45 of the tube pump 12 is reversed from the left rotation which is the rotation direction at the time of the suction operation to the right rotation which is the direction to release the pressing of the tube 22 by the roller member 43 is described, referring to FIGS. 15D and 15E.

When the rotation in the left rotation direction to perform the suction operation described in FIGS. 15B and 15C is stopped, and the drive rotating body 45 starts the right rotation (clockwise), the boss 45Bc of the drive rotating body 45 starts to move away from the end portion 44Bc1 on which the boss abuts at the time of the left rotation of the engagement hole 44Bc of the roller holding rotating member 44, to the direction of the end portion 44Bc2 on the opposite side.

Here, as in the first exemplary embodiment, the tube 22 is in the state of being pressed by the roller member 43, and receives the restoring force, so that the roller member 43 maintains the position at the time when the drive rotating body 45 starts reverse.

As the right rotation of the drive rotating body 45 proceeds, as in the first exemplary embodiment, since the cam surface 45Ba moves in the direction of the drive shaft 45*b*, the roller member 43 moves in the direction of releasing the pressing of the tube 22.

In addition, as the right rotation of the drive rotating body 45 proceeds, as in the first exemplary embodiment, the boss 45Bc of the drive rotating body 45 abuts on the end portion 44Bc2 of the engagement hole 44Bc formed on the roller holding member 44, as shown in FIG. 15E, so that the driving force of the drive rotating body 45 is transmitted to the roller holding member 44, and the roller holding member 44 starts a reverse rotation. At this point, since the cam surface 45Ba of the drive rotating body 45 moves to the position where the roller member 43 does not press the tube 22, the roller member 43 does not press the tube 22, and the tube pump 12 does not function as the suction pump.

As in the first exemplary embodiment, in the right rotation direction also, in respect to the relationship between the rotation angle of the cam surface 45*a* as described above from the first position to the second position, and the formation angle of the dead zone of the drive transmitting part, the timing at which the release of the pressing of the tube 22 is performed by the roller member 43 is certainly ahead of the timing at which the rotational movement centered on the drive shaft 45*b* of the roller member 43 starts.

First, though the position of the cam surface where the roller member 43 releases the pressing of the tube 22 is set as the second position, as in the first exemplary embodiment, the position where the tube can be present as a natural body is preferred, and also, the cam surface 45Ba and the shaft part 43Bc of the roller member can be separated.

(Effects)

Though in the first exemplary embodiment, the cam surface 25*a* of the drive rotating body 25 and the roller member 23 are disposed inside the roller holding member 24 which is a member guiding the roller member 23, in the present exemplary embodiment, the roller member 43 is disposed inside the roller holding member 44, and the cam surface 45*a* of the drive rotating body 45 is disposed outside the roller holding member 44. In the present exemplary embodiment, the cam surface which is a moving object, and the roller member which is a moved object are present in a separated region, and arranged in a more easily designed manner, and thus, the tube pump can be flexibly designed.

Other effects are identical to those in the case of the first exemplary embodiment.

Fourth Exemplary Embodiment

Next, the fourth exemplary embodiment of the tube pump of the present invention is described, referring to FIGS. 16 to 19.

Figure 16:
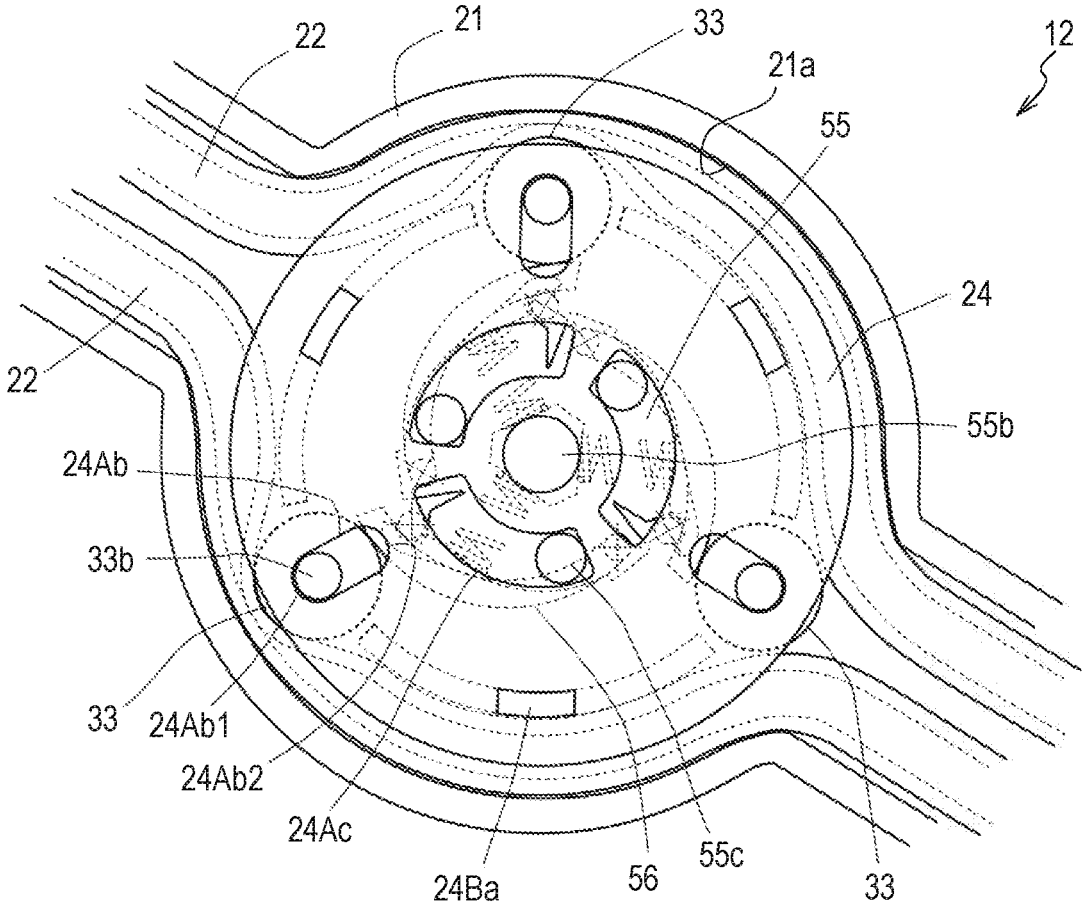
FIG. 16 is a drawing representing a configuration of the tube pump of a fourth exemplary embodiment.
Figure 17:
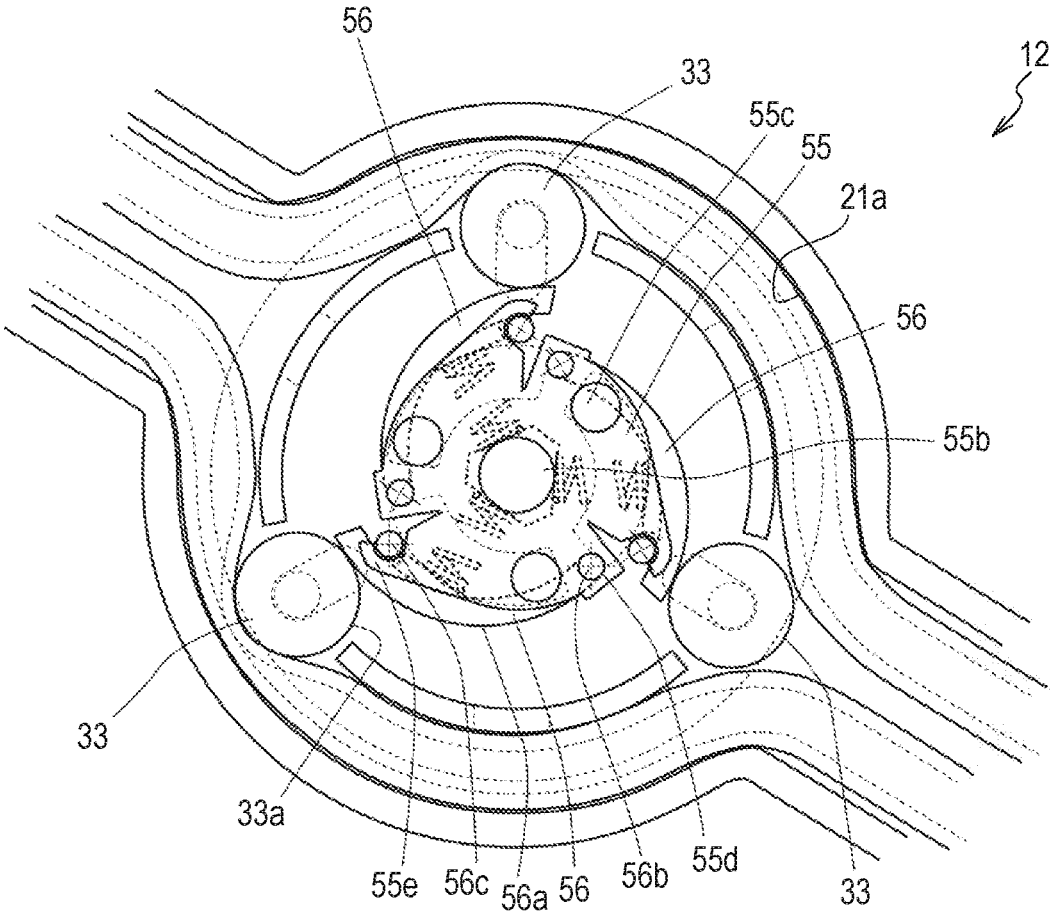
FIG. 17 is a drawing representing a configuration of the tube pump of a fourth exemplary embodiment.
Figure 18:
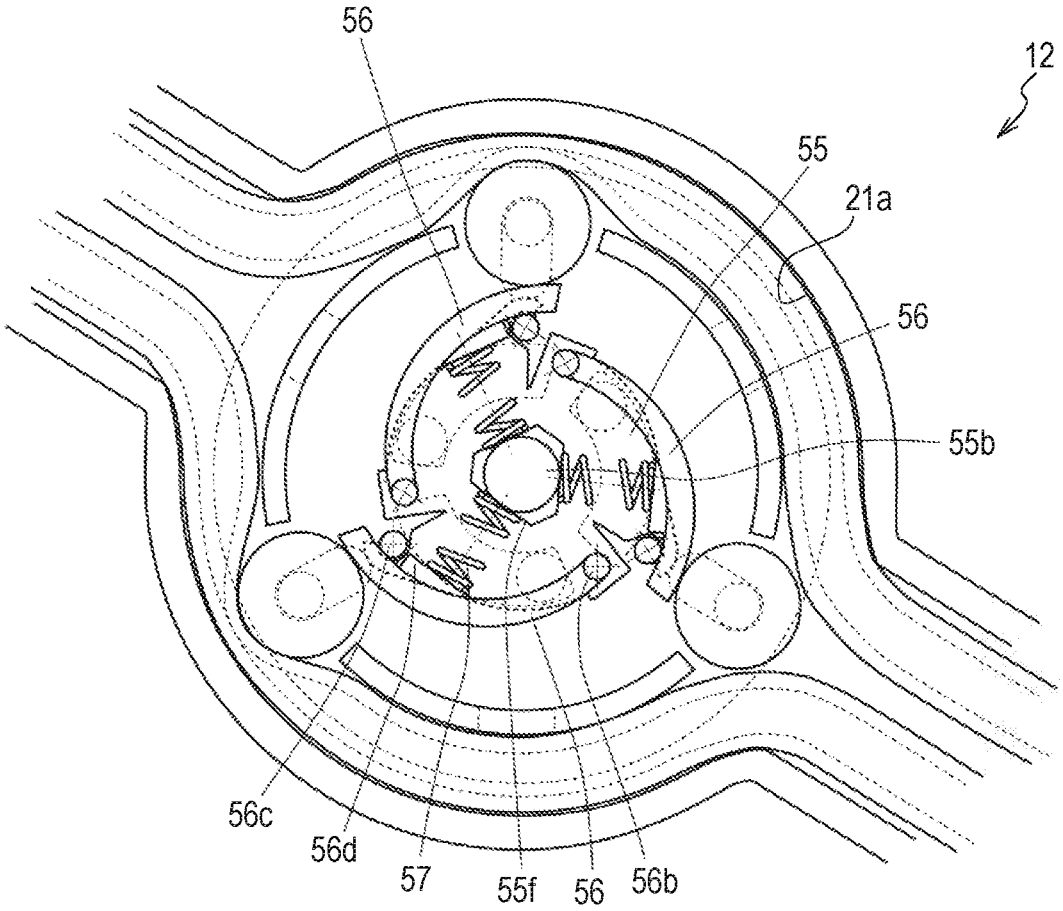
FIG. 18 is a drawing representing a configuration of the tube pump of a fourth exemplary embodiment.
Figure 19:
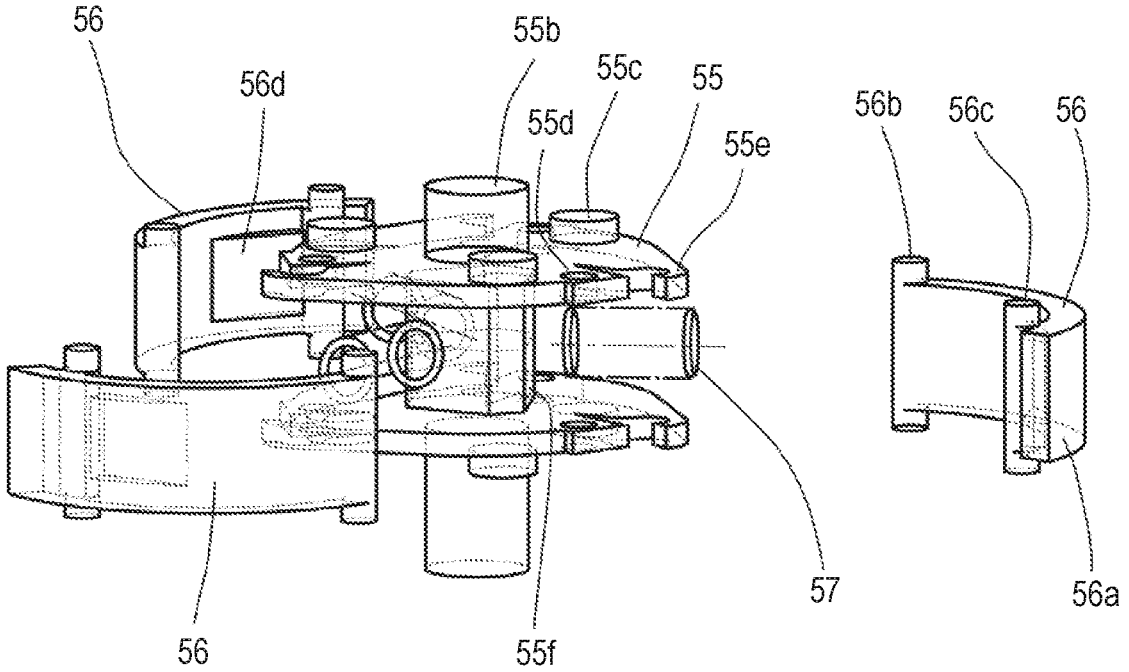
FIG. 19 is an exploded perspective view of a part of the tube pump of a fourth exemplary embodiment.

FIG. 16 is a schematic configuration diagram of the overall tube pump 12 of the present exemplary embodiment, FIG. 17 is a schematic diagram in which the member 24A which is one of the roller holding rotating member 24 is removed from FIG. 16 for describing the inside, FIG. 18 is a drawing representing the configuration of the inside of the drive rotating body of the present exemplary embodiment, and FIG. 19 is a drawing representing the component parts of the drive rotating body of the present exemplary embodiment.

In the present exemplary embodiment, the drive rotating body 35 in the second exemplary embodiment as described above is composed of three members, a drive rotating part indicated as reference numeral 55, a roller position regulating member indicated as reference numeral 56, and an urging member formed of a spring indicated as reference numeral 57.

In FIG. 16, each function of the case 21, the tube 22, the roller holding member 24, and the roller member 33 is as described in the second exemplary embodiment.

The rotation drive part 55 has a drive shaft 55*b* for receiving a drive from an external driving source to transmit driving force, a boss 55*c* for transmitting a drive by being engaged with the engagement part 24*c* of the roller holding member 24 represented in the second exemplary embodiment to transmit the drive, a bearing portion 55*d* for mounting the roller position regulating member 56 swingably, a swing regulating part 55*e* for being engaged with the roller position regulating member 56 to regulate a swing range of the roller position regulating member 56, and an urging force receiving surface 55*f* for acting the urging member 57 between the surface and the roller position regulating member 56.

The roller position regulating member 56 has the same shape as the cam surface of the drive rotating body 35 represented in the second exemplary embodiment, as the roller position regulating part 56*a*, and also has a rotating shaft 56*b* for being mounted on the bearing portion 55*d* of the rotation drive part 55, a protrusion 56*c* for being engaged with the swing regulating part 55*e* of the rotation drive part 55, and an urging seat surface 56*d* on which the urging force from the urging member 57 acts.

The rotation drive part 55, the roller position regulating member 56, and the urging member 57 have a configuration that the rotating shaft 56*b* of the roller position regulating member 56 is held by the bearing portion 55*d* of the rotation drive part 55 (pivotally supported on the rotation drive part 55), the protrusion 56*c* is incorporated in the swing regulating part 55*e* in the state of being engaged therewith, and the urging member 57 is incorporated between the urging force receiving surface 55*f* and the urging seat surface 56*d*, as shown in FIG. 18.

From the urging member 57, the roller position regulating member 56 receives the urging force in the direction in which the protrusion 56*c* side is away from the drive shaft 55*b*, around the rotating shaft 56*b*, however, the protrusion 56*c* is received by the above 55*e* to restrict the rotation about the rotating shaft 56*b*. The roller position regulating part 56*a* of the roller position regulating member 56 receives the force directed to the drive shaft 55*b*, and in the case that the force is stronger than the urging force of the urging member 57, the protrusion 56*c* is away from the swing regulating part 55*e* and swings to the drive shaft 55*b* side.

In the present configuration, when the urging force generated by the urging member 57 is set to be the force required to press the tube 22 by the roller member 33 to be in close contact with the inner wall of the tube 22, and the force balancing as a moment, in the first position described in the second exemplary embodiment, the margin for variations in size of each member is increased, and thus, it is possible to regulate the position of the roller member 33 by the roller position regulating member 56 with appropriate force to generate a suction function.

(Effects)

As described above, according to the configuration of the present exemplary embodiment, a stabilized tube pump absorbing the size variation to have a good suction function can be provided.

Other effects of the present exemplary embodiment are identical to those in the case of the first exemplary embodiment.

Fifth Exemplary Embodiment

Next, the fifth exemplary embodiment of the tube pump 12 of the present invention is described, referring to FIGS. 20 to 23.

(Configuration)

Figure 20:
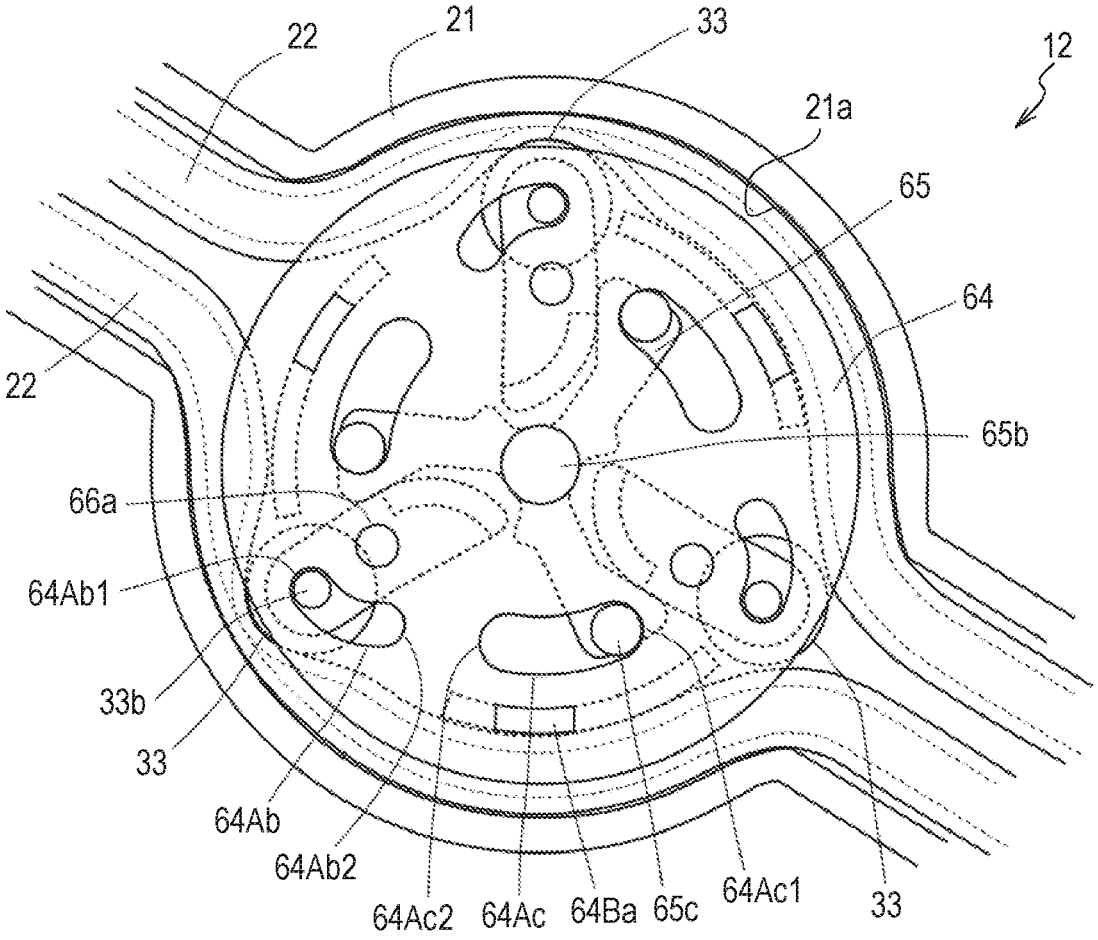
FIG. 20 is a drawing representing a configuration of the tube pump of a fifth exemplary embodiment.
Figure 21:
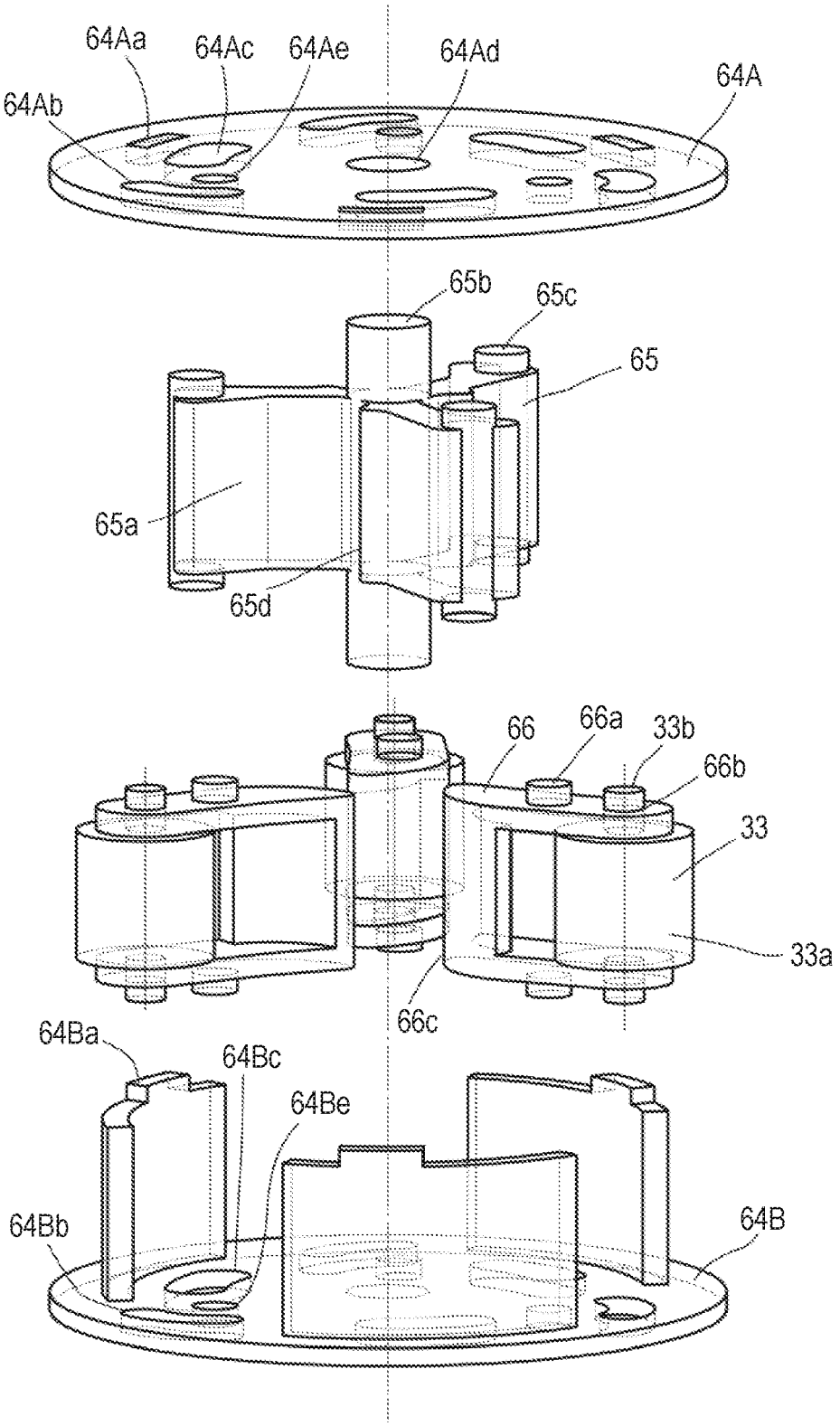
FIG. 21 is an exploded perspective view of a part of the tube pump of a fifth exemplary embodiment.

FIG. 20 is a schematic configuration diagram of the overall tube pump 12, and FIG. 21 is a configuration diagram representing the configuration of a rotor which rotates while pressing the tube 22 to generate negative pressure, or rotates in the state of not pressing the tube.

The tube pump 12 of the present exemplary embodiment includes a case 21; a tube 22; a roller member 33 (an example of a roller); a roller holding member 64 (an example of a first rotating body); a drive rotating part 65; and a roller holding lever 66. In the case of the present exemplary embodiment, a combination of the drive rotating part 65 and the roller holding lever 66 is an example of a second rotating body.

Each function of the case 21, the tube 22, and the roller member 33 is as described in the second exemplary embodiment.

The roller holding lever 66 is a lever which is engaged with the rotating shaft 33*b* (an example of a shaft part) and rotatably supports the roller member 33, and has a swing shaft 66*a* (an example of a swing shaft). In addition, it has a lever action part 66*c* for receiving pressing force from the pressing part 65*a* (an example of a protrusion) of the drive rotating part 65 to swing the lever around the swing shaft 66*a*.

The roller holding member 64 is a roller holding member which holds the swing shaft 66*a*, thereby holding the roller holding lever 66 swingably in a predetermined range. The roller holding member 64 includes two members 64A and 64B (an example of two plane members), as shown in FIG. 21. The two members are positioned outside of the rotor, respectively, and join the joining hole 64Aa provided on the member 64A and the joining convex portion 64Ba provided on the member 64B, thereby rotating integrally.

The roller holding member 64 engages the swing shaft 66*a* of the roller holding lever 66 with the swing bearings 64Ae and 64Be, and guides the rotating shaft 33*b* of the roller member 33 supported on the roller holding lever 66 by the elongated hole 64Ab and 64Bb, so that the roller member 33 held by the roller holding lever 66 can move with a predetermined angle around the swing shaft 66*a*. By the configuration, the roller member 33 can move by a predetermined distance in the direction of the rotor rotation center, and in the end portion 64Ab1 of the elongated hole 64Ab on the side close to the tube 22, the first position is taken, where the roller member 33 presses the tube 22 between the roller member and the case 21 by the cylindrical surface 33*a*, so that the inner wall of the tube 22 is in the pressed state of being closely contacted, and in the end portion 64Ab2 on the pump rotation center side, the second position is taken, where the pressed state is releasable.

The drive rotating part 65 has a boss 65*c* which is an engagement portion for transmitting the rotation drive of the drive shaft 65*b* driven by the driving source (not shown) to the roller holding member 64, and the boss 65*c* is engaged with the engagement hole 64Ac provided on the member 64A, and the engagement hole 64Bc provided on the member 64B of the roller holding member 64 to act on the end portion of the engagement hole, so that the rotation drive of the drive rotating part 65 is transmitted to the roller holding member 64.

Though the drive transmission function of the boss 65*c* of the drive rotating part 65 with the engagement hole 64Ac of the roller holding member 64 is identical to the drive transmission function of the boss 25*c* of the drive rotating part and the engagement hole 24Ac of the roller holding member 24 in the first exemplary embodiment, in the present exemplary embodiment, it works only when the boss 65*c* hits the end portion 64Ac2 in the right rotation direction of the engagement hole 64Bc, at the time of rotating in the right rotation (clockwise) direction on the opposite side to the suction direction.

The drive transmission in the left rotation (counterclockwise) direction which is the suction direction is performed by the roller holding lever 66, as described below.

The drive rotating part 65 has a pressing part 65*a* and a release action part 65*d* acting on the lever action part 66*c* of the roller holding lever 66, in the direction of a pump rotation. The release action part 65*d* is formed in a cam shape which rotates to the second position where the pressing of the tube 22 by the roller member 33 is released at the time of rotating in the reverse direction.

The drive transmission in the left rotation direction to the roller holding member 64 of the drive rotating part 65 is performed as follows: when the pressing part 65*a* presses the lever action part 66*c* of the roller holding lever as the drive rotating part 65 rotates in the left direction, the roller holding lever 66 rotates around the swing shaft 66*a*, and the rotating shaft 33*b* of the roller member 33 held by the roller holding lever 66 hits the end portion 64Ab1 on the tube 22 side of the elongated hole 64Ab. When the new left rotation of the drive rotating part 65 is performed, the roller holding lever 66 cannot rotate anymore, and thus, the force of the pressing part 65*a* of the drive rotating part 65 which presses the lever action part 66*c* becomes the force to rotate the roller holding member 64 in the left direction.

Since the drive transmission in the left rotation direction to the roller holding member 64 of the drive rotating part 65 is performed by the above configuration, the timing at which the tube 22 is pressed by the roller member 33 is set to be ahead of the timing of the drive transmission to the roller holding member 64, as in the first exemplary embodiment.

In addition, in the right rotation direction to the roller holding member 64 of the drive rotating part 65, the rotation angle (required angle) of the drive rotating part 65 required for the rotating shaft 33*b* of the roller member 33 to move (be displaced) from the first position to the second position of the elongated hole 64Ab is set to be smaller than the formation angle of the engagement hole 64Ac, as in the first exemplary embodiment.

(Operation)

Next, the operations of the roller member 33, the roller holding lever 66, the roller holding member 64, and the drive rotating part 65 depending on the rotation direction of the tube pump of the present exemplary embodiment are described, referring to FIGS. 22A, 22B, 22C, 22D, 22E, and 22F.

Figure 22A:
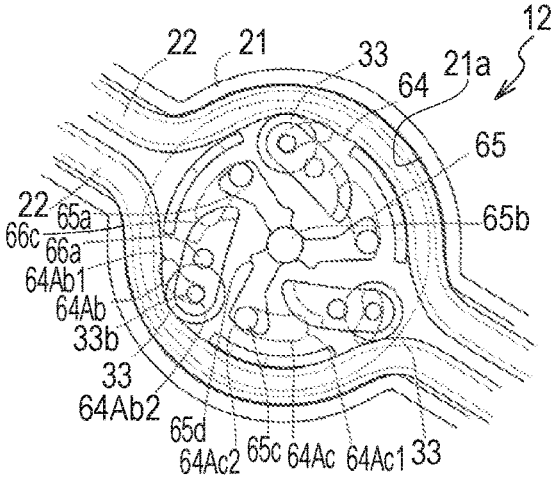
FIGS. 22A, 22B, 22C, 22D, 22E, and 22F are drawings representing the operation of each member of the tube pump of a fifth exemplary embodiment.
Figure 22B:
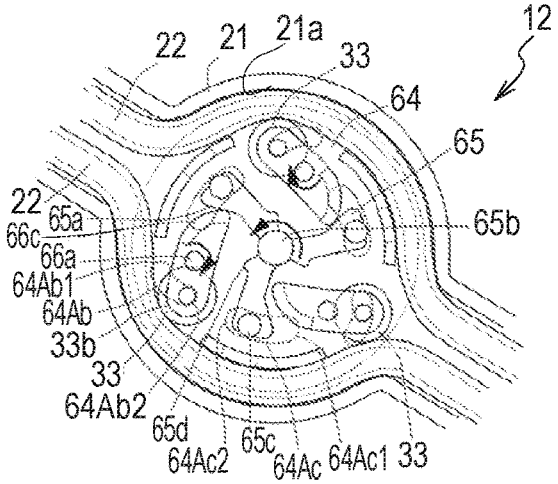
Figure 22C:
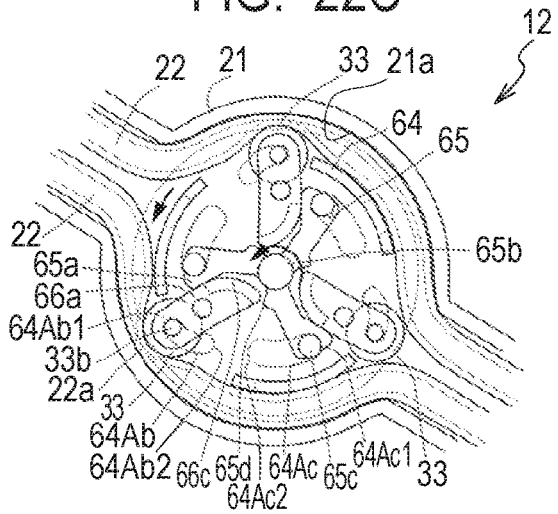

First, the case that the tube pump 12 being in the stationary state performs a suction operation is described, referring to FIGS. 22A, 22B, and 22C.

FIG. 22A illustrates a stationary state in which the tube pump 12 in the present exemplary embodiment does not work. The tube pump 12 operates until the roller member 33 releases the pressing of the tube 22, so that the pressing force does not continuously act to cause deformation of the tube 22, and then enters the stationary state.

At this point, in the stationary state shown in FIG. 22A, the boss 65*c* for transmitting the driving force to the roller holding member 64 of the drive rotating part 65 is positioned in the vicinity of the end portion 64Ac2 in the rotation direction (clockwise direction) in the engagement hole 64Ac of the roller holding member 64. In addition, the pressing part 65*a* does not act on the lever action part 66*c* of the roller holding lever 66, and the rotating shaft 33*b* of the roller member 33 in the elongated hole 64Ab can move to the vicinity of the second position. From the above, the pressing against the tube 22 by the roller member 33 is released, in the stationary state.

FIG. 22B illustrates that the drive rotating part 65 starts rotation in the left rotation direction (counterclockwise) which is the suction operation direction of the tube pump 12, in the stationary state of FIG. 22A.

The boss 65*c* of the drive rotating part 65 starts to move away from the end portion 64Ac2 of the engagement hole 64Ac of the roller holding member 64 toward the end portion 64Ac1 on the opposite side. In this state, since the drive rotating part 65 and the roller holding lever 66 are not engaged, the driving force in the left rotation direction of the drive rotating part 65 is not transmitted to the roller holding member 64.

Meanwhile, the pressing part 65*a* of the drive rotating part 65 starts to act on the lever action part 66*c* of the roller holding lever 66, and by the pressing force, the roller holding lever 66 starts right rotation around the swing shaft 66*a*. Thus, the roller member 33 starts to move from the end portion 64Ab2 of the radial inside (rotation center side) toward the end portion 64Ab1 close to the tube 22, in the elongated hole 64Ab of the roller holding member 64, and starts to gradually press the tube 22 (see FIG. 22B).

In order that the action force acting on the lever action part 66*c* of the pressing part 65*a* efficiently rotates the roller holding lever 66 in the right direction, the position of the end portion 64Ab2 of the elongated hole 64Ab in which the rotating shaft 33*b* of the roller member 33 at rest is positioned is important, and when the drive rotating part 65 starts left rotation (counterclockwise rotation), the action force to the lever action part 66*c* in the pressing part 65*a* is required to serve as a moment to rotates the roller holding lever 66 in the right direction around the swing shaft 66*a*. For this purpose, when the rotating shaft 33*b* is positioned in the end portion 64Ab2 of the elongated hole 64Ab, it is preferred to set the position of the end portion 64Ab2 so that the angle formed by a straight line connecting the center of the rotating shaft 33*b* and the center of the swing shaft 66*a* and a straight line connecting the center of the rotating shaft 33*b* and the center of the drive shaft 65*b* is 90° or less.

As the left rotation of the drive rotating part 65 proceeds, the roller holding lever 66 is pushed until the rotating shaft 33*b* of the roller member 33 reaches the tube side end 64Ab1 of the elongated hole 64Ab, so that the roller member 33 moved to the first position. Thus, the tube 22 is in the state of being pressed until the inner walls are in close contact with each other (see FIG. 22C).

Next, as the left rotation of the drive rotating part 65 is further proceeds, by the configuration as described above, the driving force in the left rotation direction of the drive rotating part 65 is transmitted to the roller holding member 64 through the roller member 33, the roller holding lever 66 and the pressing part 65*a* reaching the end portion 64Ab1, so that the roller holding member 64 also starts left rotation. In this state, though the boss 65*c* of the drive rotating part 65 comes close to the end portion 64Ac1 on the left rotation side of the engagement hole 64Ac, it is preferred that the boss does not hit thereon. This is because the position in the radial direction of the roller member 33 is determined by the position of the tube end portion 64Ab1 of the elongated hole 64Ab to stabilize the pressing amount of the tube 22.

FIG. 22C illustrates that the boss 65*c* reaches the end portion 64Ac1 of the engagement hole 64Ac, and the driving force in the left rotation direction of the drive rotating part 65 is transmitted to the roller holding member 64 to rotate in the left direction. In this case, the roller member 33 presses the tube 22 until the inner walls of the tube 22 are in close contact with each other, so that the roller holding member 64 holding the roller member 33 performs left rotation. Therefore, negative pressure is generated on the upstream side of the rotation direction at the position 22*a* where the tube 22 is pressed, and the tube pump 12 functions as the suction pump.

Figure 22D:
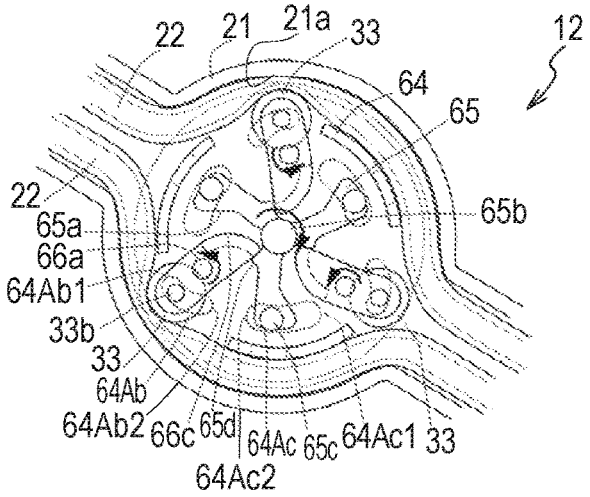
Figure 22E:
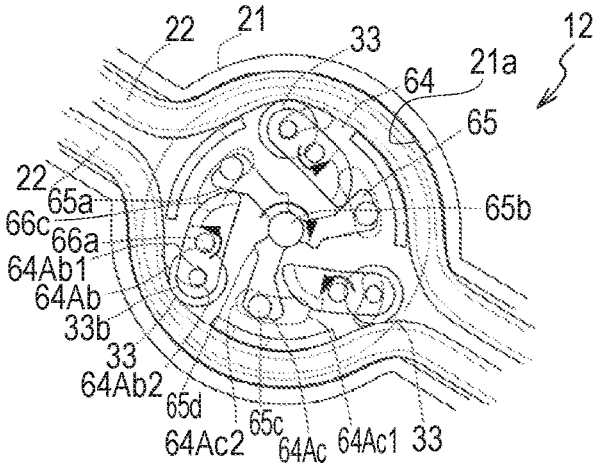
Figure 22F:
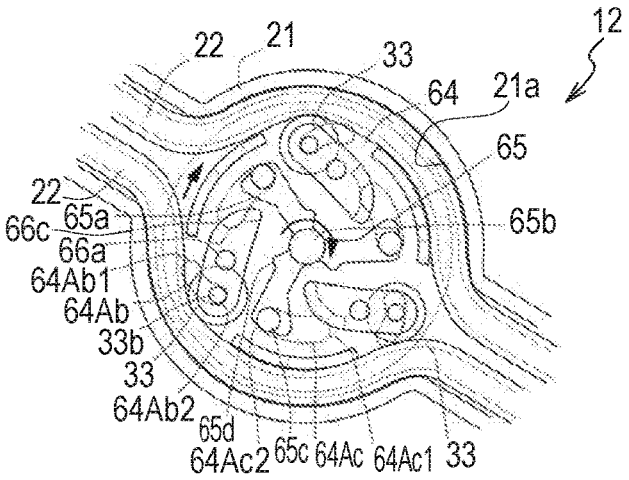

Next, the movement of each part when the tube pump 12 performing the suction operation is reversed from the left rotation in the suction direction to the right rotation to rotate in the right direction is described, referring to FIGS. 22D, 22E, and 22F.

When the driving source rotating the drive rotating part 65 reverses the driving direction, the drive rotating part 65 rotates in the direction opposite to the rotation direction (right rotation direction, or clockwise rotation direction) at the time of the suction operation (see FIGS. 22B and 22C). Accordingly, the pressing part 65*a* of the drive rotating part 65 is separated from the lever action part 66*c* of the roller holding lever 66. In this case, the roller holding member 64 is stopped by the action of the repulsive force to the pressing of the tube 22 on the roller member 33.

Figure 23:
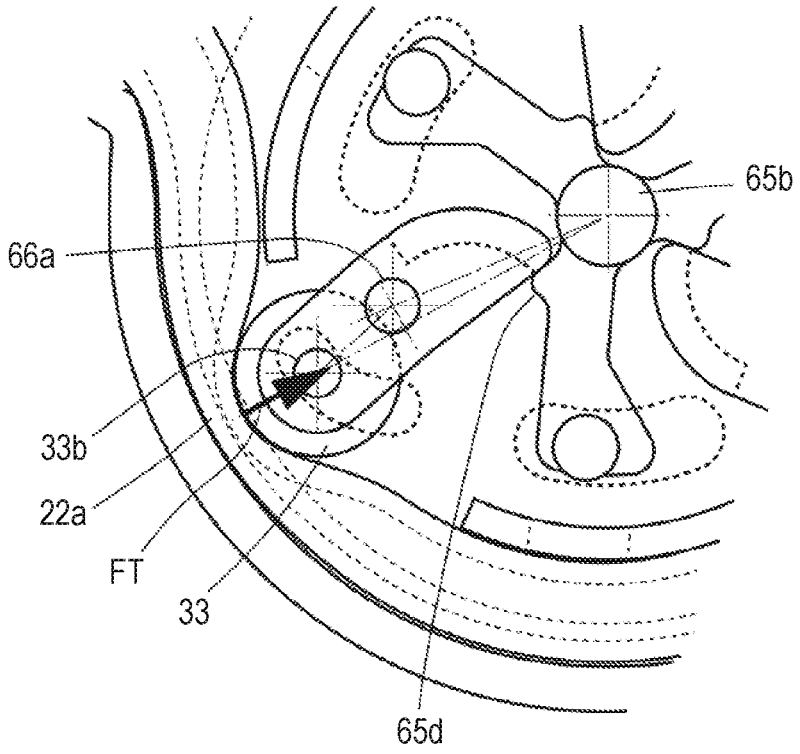
FIG. 23 is a drawing representing the reaction force of a tube to a roller member of the tube pump of a fifth exemplary embodiment.

As the rotation of the drive rotating part 65 proceeds, the release action part 65*d* of the drive rotating part 65 comes into contact with the lever action part 66*c* to start to press the lever action part 66*c*, as shown in FIG. 22D. As a result, the roller holding lever 66 starts left rotation (counterclockwise rotation), and the rotating shaft 33*b* of the roller member 33 is separated from the tube side end 64Ab1 of the elongated hole 64Ab. Here, as shown in FIG. 23, the repulsive force of the tube 22 presses the rotating shaft 33*b* of the roller member 33 toward the rotation center side, that is, the drive shaft 65*b* of the drive rotating part 65, in the pressed position 22*a* by the roller member 33. Meanwhile, since the lever action part 66*c* is pushed by the release action part 65*d* with the position of the roller member 33 being not moved, and the roller holding lever 66 rotates in the left direction (counterclockwise), the swing shaft 66*a* of the roller holding lever 66 moves in the right rotation direction (the upper left direction in FIG. 23) around the drive shaft 65*b*. At this point, the repulsive force of the tube 22 to act on the roller member 33 serves as a moment to rotate the roller holding lever 66 in the left direction (counterclockwise rotation). Therefore, as the right rotation (clockwise rotation) of the drive rotating part 65 proceeds, the tube repulsive force in addition to the pressing force of the release action part 65*d* serves as a moment to rotate the roller holding lever 66 in the left direction. As a result, as shown in FIG. 22E, the roller holding lever 66 rotates around the swing shaft 66*a* by the repulsive force of the tube 22. The rotating shaft 33*b* of the roller member 33 reaches the end portion 64Ab2 on the rotation center side of the elongated hole 64Ab (reaches the second position where the pressed state of the tube 22 is released).

In order to perform the above operation more efficiently, for example, the following may be carried out. That is, in the first position, the position of the tube side end 64Ab1 is set so that the angle formed by a straight line connecting the center of the swing shaft 66*a* and the center of the rotating shaft 33*b* and a straight line connecting the center of the swing shaft 66*a* and the center of the drive shaft 65*b* is less than 180°.

Then, when the drive rotating part 65 further rotates in the right direction (clockwise rotation), the boss 65*c* of the drive rotating part 65 abuts on the end portion 64Ac2 of the engagement hole 64Ac formed in the roller holding member 64, as shown in FIG. 22F. As a result, the driving force of the drive rotating part 65 is transmitted to the roller holding member 64, and the roller holding member 64 starts the right rotation. In this case, since the roller member 33 moves to the position where the tube 22 is not pressed, the roller member 33 does not press the tube 22, and moves in the rotation direction, and the tube pump 12 does not serve as the suction pump.

As described above, the present exemplary embodiment represents the cam surface of the drive rotating body as a combination of the roller holding lever 66, the pressing part 65*a* of the drive rotating part 65, and the release action part 65*d*, which is represented as acting on the position of the roller member in the first to fourth exemplary embodiments described first.

(Effects)

As in the first exemplary embodiment, in the present exemplary embodiment, the tube pump 12 which does not produce a reverse flow of ink and positive pressure in the tube 22, and furthermore in the cap 8, when the pump is reversed from the suction direction to the reverse direction and starts to rotate, with a simple configuration, using the restoring force of the tube 22, can be provided.

As described above, the present invention has been described with reference to the above exemplary embodiments as an example, however, the technical scope of the present invention is not limited to the present exemplary embodiment.

The tube pump of the present invention can suppress the occurrence of the backflow of liquid in the tube at the time of reverse rotation of the second rotating body, with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-155639, filed Aug. 10, 2017, which is hereby incorporated by reference herein in its entirety.

What is claimed is:

1. A tube pump comprising:

a tube having elastic restoring force;

a case supporting a part of the tube along a wall surface;

a roller capable of moving between a first position in which the roller presses the tube to the wall surface and a second position in which the roller does not press the tube to the wall surface;

a first rotating body having a guiding part for transmitting a rotational driving force to the roller, the roller being guided by the guiding part as the roller moves between the first position and the second position;

a second rotating body having (i) a regulating part for regulating a position of the roller and configured to move the roller to the first position and (ii) a drive transmitting part for transmitting a rotational driving force to the first rotating body;

wherein, when the second rotating body is rotated in a first direction, the drive transmitting part is configured to rotate the first rotating body and the regulating part is configured to move the roller to the first position as the roller is guided by the guiding part, and wherein, when the second rotating body is rotated in a second direction opposite to the first direction from a state in which the regulating part regulates the roller to the first position, the regulating part is configured to release regulating the roller to the first position while the drive transmitting part changes from a state in which the drive transmitting part does not transmit a drive to the first rotating body to a state in which the drive transmitting part transmits a drive to the first rotating body.

2. The tube pump according to claim 1, wherein the wall surface is arc-shaped, wherein the roller has a cylindrical part acting on the tube, the cylindrical part having a first end, a second end and a shaft, the shaft provided on each of the first end and the second end of the cylindrical part, wherein the first rotating body has two plane members sandwiching the cylindrical part of the roller in a direction of the shaft, and wherein the guiding part of the first rotating body includes an elongated hole on each of the two plane members, the elongated hole being elongated in a radial direction of the arc-shaped wall surface, each elongated hole guiding the shaft of the roller.

3. The tube pump according to claim 2, wherein each elongated hole includes a first end and a second end, the first end of the respective elongated hole being an end proximate to the arc-shaped wall surface, wherein, when the roller is in the first position, the shaft of the roller is positioned at the first end of each elongated hole, and wherein, when the roller is in the second position, the shaft of the roller is positioned at the second end of each elongated hole.

4. The tube pump according to claim 2, wherein each of the two plane members includes an arc-shaped elongated hole centered on a rotation center of the first rotating body, wherein the drive transmitting part includes a plurality of protrusions, each of the protrusions engaging the arc-shaped elongated hole provided on the two plane members and being configured to move in elongated hole as the second rotating body rotates, and wherein, when each protrusion is positioned at an end portion of the elongated hole, the protrusion presses end portion of the elongated hole, thereby rotating the first rotating body by rotational driving force of the second rotating body.

5. The tube pump according to claim 2, wherein the regulating part acts on the shaft.

6. The tube pump according to claim 2, wherein the regulating part acts on the cylindrical part.

7. The tube pump according to claim 1, wherein the regulating part includes a regulating surface defining a position of the roller in the guiding part from the second position to the first position, the regulating surface having (i) a portion in which the radial distance of the regulating surface from a rotation center of the second rotating body is gradually changed over a predetermined rotation angle in a circumferential direction of the second rotating body, and (ii) a portion in which the regulating surface has a constant radial distance from the rotation center of the second rotating body over another predetermined rotation angle in the circumferential direction of the second rotating body.

8. The tube pump according to claim 7, wherein the radial distance of the regulating surface is changed by a total radial distance and each elongated hole has a length, the total radial distance being less than the length of the elongated hole.

9. The tube pump according to claim 1, wherein the regulating part is formed integrally with the second rotating body.

10. The tube pump according to claim 1, wherein the regulating part is maintained so that the side of the second rotating body close to a rotation center of the second rotating body is pivotally supported on the second rotating body, and wherein the side of the second rotating body distant from the rotation center of the second rotating body is maintained swingably and is urged in a direction of away from the rotation center of the second rotating body by an urging member provided between the regulating part and another portion of the second rotating body.

11. The tube pump according to claim 1, wherein the roller has a cylindrical part acting on the tube, the cylindrical part having a first end, a second end and a shaft, the shaft provided on each of the first end and the second end of the cylindrical part, wherein the roller is held by a roller holding lever including as roller holding part engaged with the shaft of the roller, (ii) an action part receiving an action of the regulating part of the second rotating body, and (iii) a swing shaft configured to swinging the roller when the action part receives an action of the regulating part, and wherein the first rotating body has two plane members sandwiching the roller holding lever in a direction of the shaft, each of the plane members including a swing bearing for holding the swing shaft of the roller holding lever, a portion of the guiding part being provided on each of the plane members.

12. The tube pump according to claim 11, wherein the wall surface is arc-shaped, wherein the guiding part includes an elongated hole on each of the two plane members, the elongated hole (i) having the shape of an arc centered on the swing shaft of the roller holding lever, and being elongated in a radial direction of the arc-shaped wall surface of the case, and wherein the shaft of the roller is engaged with the roller holding part of the roller holding lever and each of the elongated holes.

13. The tube pump according to claim 12, wherein each elongated hole includes a first end and a second end, the first end of the respective elongated hole being an end proximate to the arc-shaped wall surface, wherein, when the roller is in the first position, the shaft of the roller is positioned at the first end of each elongated hole, and wherein, when the roller is in the second position, the shaft of the roller is positioned at the second end of each elongated hole.

14. The tube pump according to claim 13, wherein each of the two plane members includes an arc-shaped elongated hole centered on a rotation center of the first rotating body, wherein the drive transmitting part includes a plurality of protrusions, each of the protrusions engaging the arc-shaped elongated hole provided on the two plane members and being configured to move in elongated hole as the second rotating body rotates, and wherein, when each protrusion is positioned at an end portion of the elongated hole, the protrusion presses end portion of the elongated hole, thereby rotating the first rotating body by rotational driving force of the second rotating body.

15. The tube pump according to claim 14, wherein the regulating part includes a cam shape which, when rotated in a predetermined direction, acts on the action part of the roller holding lever to rotate the roller holding lever about the swing shaft to position the roller in the first position, and which, when rotated in a reverse direction opposite the predetermined direction, rotates the roller holding lever about the swing shaft to position the roller in the second position.

16. The tube pump according to claim 15, wherein an angle of rotation of the second rotating body centered on a rotation center of the second rotating body required to displacing the roller holding lever an move the roller from the second position to the first position is smaller than an angle formed between each end of each elongated hole centered on the rotation center of the first rotating body.

17. A tube pump according to claim 1, wherein, when the second rotating body is rotated in the second direction from a state in which the regulating part regulates the roller to the first position, the roller is configured to slide in the guiding part as the regulating part releases the regulation of the roller and the roller moves from the first position to the second position while the drive transmitting part changes from a state in which the drive transmitting part does not transmit a drive to the first rotating body to a state in which the drive transmitting part transmits a drive to the first rotating body.

18. An inkjet recording apparatus comprising:

a recording head configured to eject ink to a recording medium;

a cap covering an ejection orifice surface of the recording head;

a tube having elastic restoring force;

a case supporting a part of the tube along a wall surface, a roller capable of moving between a first position in which the roller presses the tube to the wall surface and a second position in which the roller does not press the tube to the wall surface;

a first rotating body having a guiding part for transmitting a rotational driving force to the roller, the roller being guided by the guiding part as the roller slides between the first position and the second position;

a second rotating body having (i) a regulating part for regulating a position of the roller and configured to move the roller to the first position and (ii) a drive transmitting part for transmitting a rotational driving force to the first rotating body;

wherein, when the second rotating body is rotated in a first direction, the drive transmitting part is configured to rotate the first rotating body and the regulating part is configured to move the roller to the first position as the roller is guided by the guiding part, and wherein, when the second rotating body is rotated in a second direction opposite to the first direction from a state in which the regulating part regulates the roller to the first position, the regulating part is configured to release regulating the roller to the first position while the drive transmitting part changes from a state in which the drive transmitting part does not transmit a drive to the first rotating body to a state in which the drive transmitting part transmits a drive to the first rotating body.

* * * * *